United States Patent [19]

Mihara

[11] Patent Number: 4,502,772

[45] Date of Patent: Mar. 5, 1985

[54] APPARATUS FOR TREATING DISC FILMS

[75] Inventor: Nobuaki Mihara, Wakayama, Japan

[73] Assignee: Noritsu Kenkyu Center Co. Ltd., Wakayama, Japan

[21] Appl. No.: 494,515

[22] Filed: May 13, 1983

[30] Foreign Application Priority Data

May 17, 1982 [JP] Japan ..... 57-81470
Jun. 15, 1982 [JP] Japan ..... 57-101463

[51] Int. Cl.[3] ..... G03D 3/08

[52] U.S. Cl. ..... 354/312; 354/308; 354/322; 354/330

[58] Field of Search ..... 354/308, 312, 320, 321, 354/322, 330, 316

[56] References Cited

U.S. PATENT DOCUMENTS

| | | | |
|---|---|---|---|
| 3,314,352 | 4/1967 | Grant | 354/308 |
| 4,112,452 | 9/1978 | Patton | 354/322 |
| 4,112,453 | 9/1978 | Hutchison | 354/330 |
| 4,178,088 | 12/1979 | Harding | 354/308 |
| 4,178,091 | 12/1979 | Solomon | 354/322 |
| 4,179,207 | 12/1979 | Phillips | 354/308 |
| 4,252,430 | 2/1981 | Michal | 354/322 |

*Primary Examiner*—A. A. Mathews

[57] ABSTRACT

A new and unique apparatus for specially treating photosensitive material in the form of disc films which have been lately developed but have a limited quantity of demand at present is disclosed in which a series of treatments starting with developing and ending with drying are automatically practiced for the disc films inserted in the apparatus. A plurality of treating tanks, a squeeze tank and a drier are arranged in line in the dark box of the apparatus, while a holder insert port is disposed at the one end part and a holder discharge port is disposed at the other end part of the apparatus. A hanger including a rotary disc film supporting shaft at the lower end part thereof so as to carry the disc film to be treated is slidably mounted on a movable rail which is caused to repeatedly practice a series of movements comprising raising, forward movement, lowering and backward movement, accompanied by a temporary stop at the lowermost end position. The disc films are subjected to an intended treatment in each of the treatment tanks while they are rotated on a disc film supporting shaft rotatably held on the hanger. Further, a hanger displacement prevention system including a rotational force transmission mechanism and a hanger backward movement prevention member is provided for the purpose of inhibiting backward movement of the hanger a little bit before the movable rail reaches the lowermost end position.

11 Claims, 28 Drawing Figures

40
42
41
H2
43
53'
53'
58'
58'
52'
52'
54'
54'
51'
56'
56'
54'
53'
52'
52'
54'
54'
D
57'
50'

FIG. 15
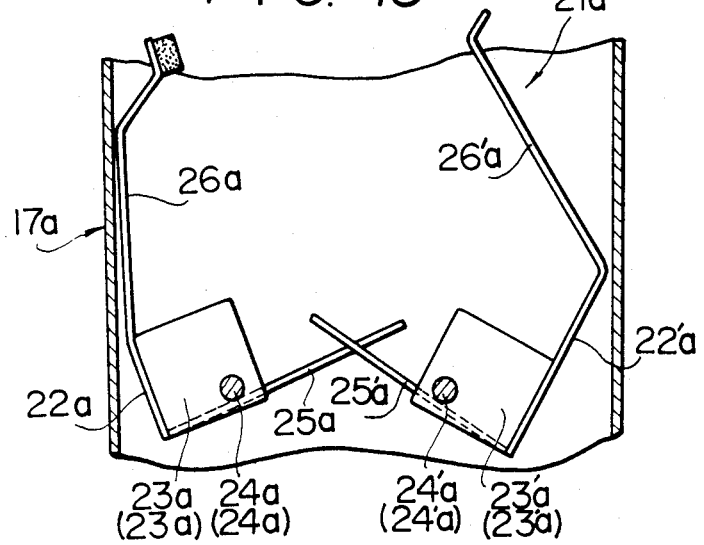
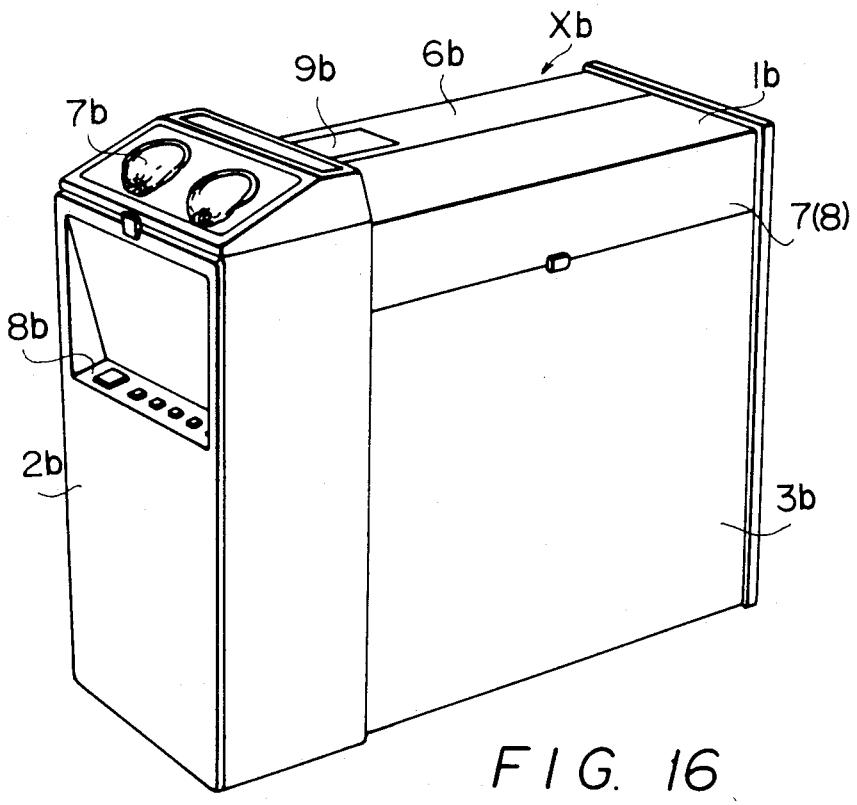
FIG. 16

APPARATUS FOR TREATING DISC FILMS

BACKGROUND OF THE INVENTION

1. Field of the Invention

The present invention relates to an apparatus for treating photosensitive material and more particularly to a new apparatus for specially treating circular disc-shaped photographic films, that is, so-called disc films which have been lately developed but have a relative small quantity of demand at present, in which a series of treatments comprising developing, bleaching, fixing and film stabilizing are practiced for the disc films with washing steps interposed between the successive steps, followed by drying and other steps. Further, the present invention relates to an apparatus for treating both conventional long length photosensitive films and disc films in combination with a conventional apparatus with excellent economical effect assured.

2. Description of the Prior Art

In recent years circular disc-shaped photographic films, that is, so-called disc films have been developed which are designed so as to have an outer diameter of about 6.5 cm for the disc plate and an inner diameter of about 1 cm for the fitting hole at the central part thereof and of which exposing sections for taking a photograph are arranged along the periphery of the disc plate and therefore the conventional long length photographic films such as 35 mm films or the like are gradually replaced with the newly developed disc films. To photographically treat disc films there have been already proposed a few treating apparatuses or treating machines for treating disc films in which a series of treating steps starting with developing and ending with drying are practiced for them, as disclosed in U.S. Pat. Nos. 4,112,452, 4,178,091, 4,252,430 and others. However, it is pointed out as a problem with respect to the proposed treating apparatuses or machines that they are generally constructed with the same or substantially same quantity of consumption as that of the conventional long length photographic films in mind. Accordingly, they are not acceptable as a treating apparatus or machine for treating disc films which has a relatively small quantity of demand at present not only from the viewpoint of economy but also from the viewpoint of practicability.

BRIEF SUMMARY OF THE INVENTION

Thus, the present invention has been made with the foregoing problem in mind. The present invention discloses an apparatus for automatically carrying out a series of treating steps staring with developing and ending with drying for the disc films which have been lately developed but have a relatively small quantity of demand still yet as photosensitive material. Specifically, the apparatus of the present invention is constructed such that a hanger handling plate with light shielding bags fitted therewith is provided at the one end part of a dark box through which disc films to be treated and hangers for carrying said disc films thereon are inserted into the apparatus while a hanger discharge port with a light shielding member fitted thereto is provided at the other end part of the dark box and a plurality of treating tanks, a squeeze tank section and a drier section are arranged in line in the dark box, wherein a hanger transporting mechanism comprising a movable rail and a hanger backward movement prevention member is provided, said movable rail being extended above the group of treating tank sections so that hangers slidably fitted onto the movable rail repeatedly practices a series of movements comprising raising, forward movement, lowering and backward movement accompanied by a temporary stop at the lowermost end position while they hold disc films rotatably supported on a disc film supporting shaft and said hanger backward movement prevention member being caused to inhibit backward movement of the hangers a little bit before the movable rail reaches the lowermost end position and including a rotational force transmission system by way of which rotational force of a motor is transmitted to the disc film supporting shaft. Further, according to another aspect of the present invention there is proposed an apparatus for treating photosensitive material comprising a combination of an apparatus section for specially treating disc films with a conventional apparatus section for treating long length photographic films such as 35 mm films or the like.

Thus, it is a principal object of the present invention to provide a new apparatus for practicing a series of treating steps including from developing till drying at a high efficiency for disc films which have been lately developed but have a small quantity of consumption at present compared with the whole consumption of photosensitive material, although a tendency of increase of consumption has been recognized year by year.

It is another principal object of the present invention to provide a treating apparatus for specially treating disc films at an excellently high treating efficiency which is designed and constructed in smaller dimensions so as to fit well the current small quantity of consumption of disc films.

It is other object of the present invention to provide a treating apparatus for specially treating disc films which is easy to be operated at an inexpensive cost.

It is still further object of the present invention to provide a treating apparatus for treating both disc films and conventional long length photographic films which essentially comprises a combination of an apparatus section for specially treating disc films with a conventional apparatus section for treating conventional long length photographic films, said combination being effected by jointing both the apparatus sections side by side in such a manner that a part of the one apparatus section serves also as a part of the other apparatus section while the same kind of treating liquids are used for both the apparatus sections, so that reduced space required for mounting the whole apparatus and economical operation of the same are assured.

Other objects, features and advantages of the invention will be apparent from reading of the following description made in conjunction with the accompanying drawings.

BRIEF DESCRIPTION OF THE DRAWINGS

The accompanying drawings illustrating a treating apparatus for treating photosensitive material, that is, a treating apparatus for specially treating disc films in accordance with a few preferred embodiments of the present invention will be briefly described below. It should be noted that insignificant structural parts or components well known to any expert in the art are not shown for the purpose of simplification of illustration.

FIGS. 9 to 12 schematically illustrate how the hanger transporting mechanism is constructed and operated, wherein FIG. 9 is a side view of the transporting mechanism with a part thereof cut off for the sake of convenience of illustration, particularly illustrating the transporting mechanism when the movable rail is raised up, FIG. 10 is an enlarged view of the transporting mechanism with a part thereof removed, as seen from the rear part of the movable rail, FIG. 11 is a side view of the transporting mechanism with a part thereof cut off, particularly illustrating the transporting mechanism when the movable rail is lowered, and FIG. 12 is an enlarged view similar to FIG. 10, particularly illustrating how rotational force of a motor is transmitted to a disc film supporting shaft on the hanger in the squeeze tank section on which the treated dics films are held while rotating at a high speed.

FIGS. 13 to 15 schematically illustrate how a water droplet scattering prevention member is constructed and operated, wherein FIG. 13 is a side view of the water droplet scattering prevention member, illustrating that the treated disc films are covered with it, FIG. 14 is a perspective view of a pair of main components for the water droplet scattering prevention member and FIG. 15 is a side view of the water droplet scattering prevention member in the squeeze tank section, particularly illustrating how the components in FIG. 14 are held in an inoperative state.

FIG. 16 is a perspective view of a treating apparatus for treating photosensitive material, that is, a treating apparatus for specially treating disc films in accordance with the second embodiment of the invention.

DESCRIPTION OF THE PREFERRED EMBODIMENTS

Now, an apparatus for treating photosensitive material in the form of a disc film in accordance with the present invention will be described in detail with respect to the first to third embodiments as illustrated in the accompanying drawings, wherein said apparatus has been developed as a disc film treating apparatus in which a small quantity of disc films are subjected to a series of treating steps starting with development and ending with drying.

Figure 1:
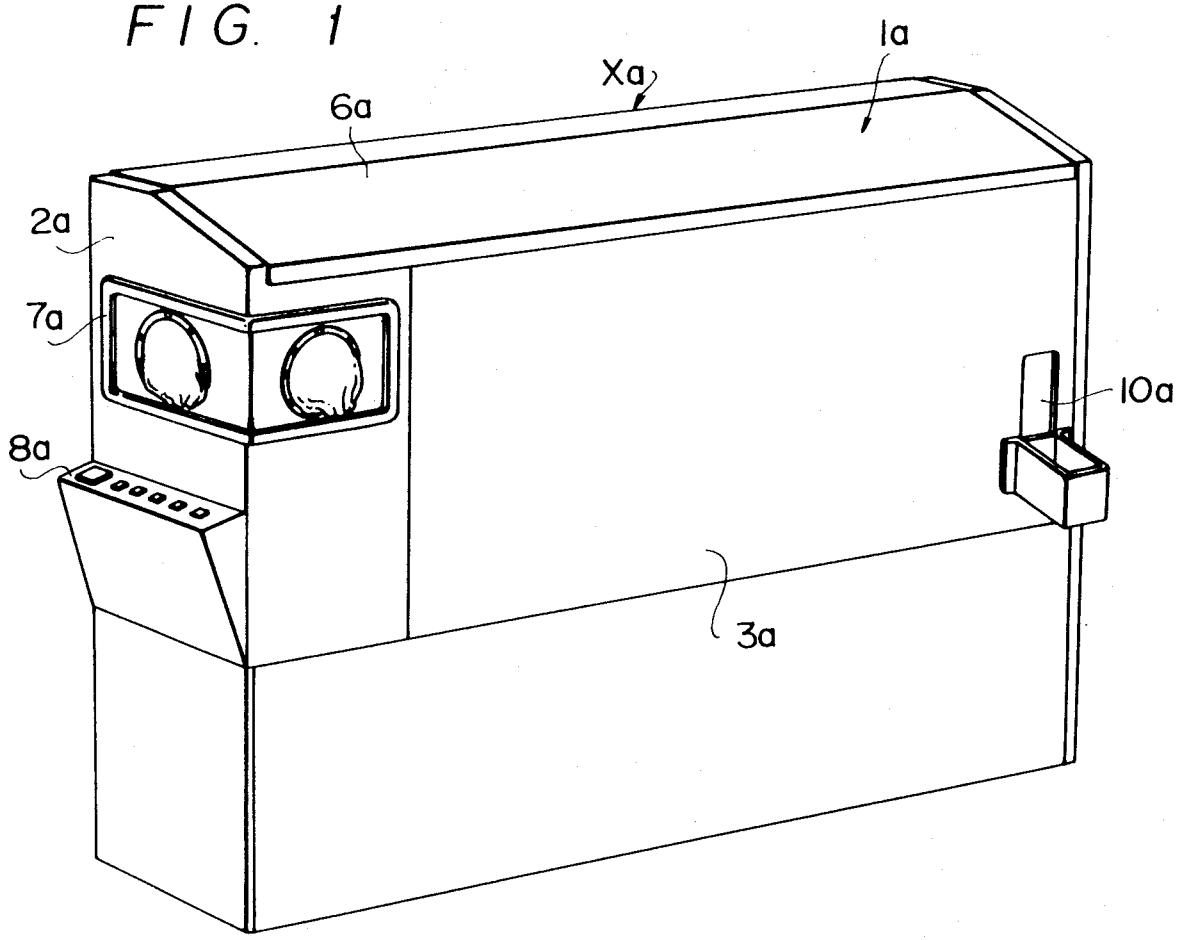
FIG. 1 is a perspective view schematically illustrating a treating apparatus for treating photosensitive material, that is, a treating apparatus for specially treating disc films in accordance with the first embodiment of the present invention.

First, description will be made as to an apparatus for treating photosensitive material in accordance with the first embodiment of the invention, that is, a disc film treating apparatus for specially treating disc films in accordance with the first embodiment of the invention mainly with reference to FIG. 1 which is a perspective view illustrating the general structure of the treating apparatus and additionally with reference to FIG. 2 which is a sectional plan view of the same. In the drawings reference letter *Xa* generally designates an apparatus for specially treating disc films, reference numeral 1a does an outer panel constituting frame structure and a dark box for the treating apparatus Xa, reference numeral 2a does a front panel, reference numeral 3a does a rightand side panel, reference numeral 4a does a lefthand side panel, reference numeral 5a does a rear panel and reference numeral 6a does an upper panel. Further, reference numeral 7a designates a removable hanger handling plate with light shielding bags fitted therewith, said hanger handling plate 7a extending across both the panels 2a and 3a and openable for inserting disc films D and disc film holding hangers H (see FIGS. 4, 7) therethrough and reference numeral 8a does a control panel disposed below the hanger handling plate 7a on the front panel 2a. A plurality of switch buttons, push bottons and displays are arranged on the upper surface of the control panel 8a in the same manner as the conventional apparatus for the purpose of starting or stopping operations of the respective parts or components simultaneously or individually, controlling a working speed and displaying the existing operating or working conditions. Further, reference numeral 10a designates a hanger discharge port with a light shielding member fitted therewith which will be described later, said hanger discharge port 10a being located at the rear and part of the righthand side panel 3a.

Figure 2:
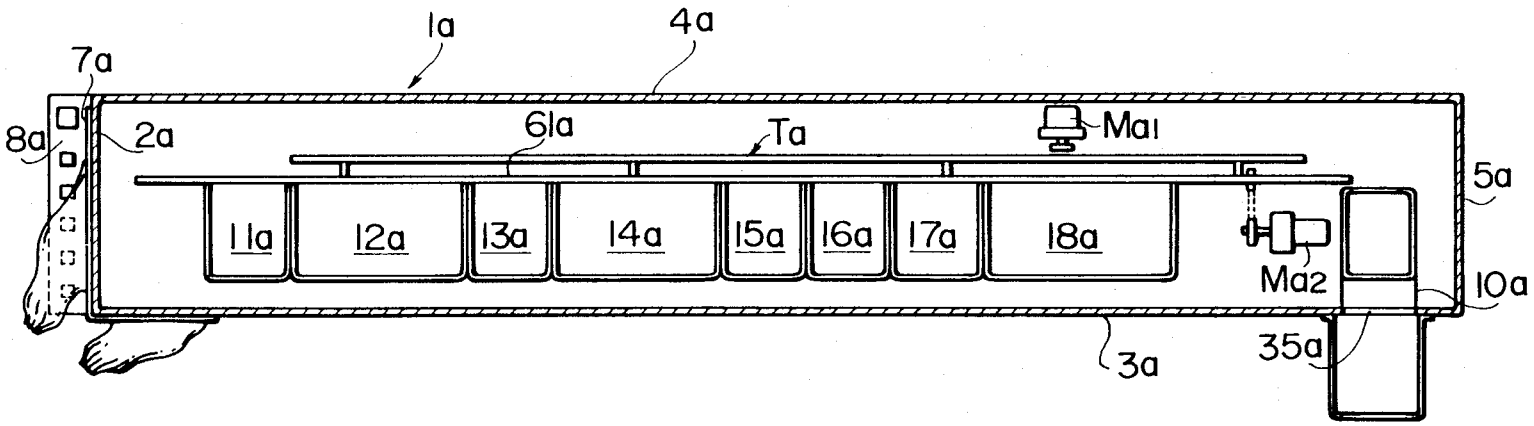
FIG. 2 is a plan view of the apparatus in FIG. 1 with an upper panel removed therefrom, schematically illustrating how a plurality of treating tanks, a squeeze tank section, a drier section and a transporting mechanism for hangers with disc films fitted thereon are arranged in the dark box.
Figure 3:
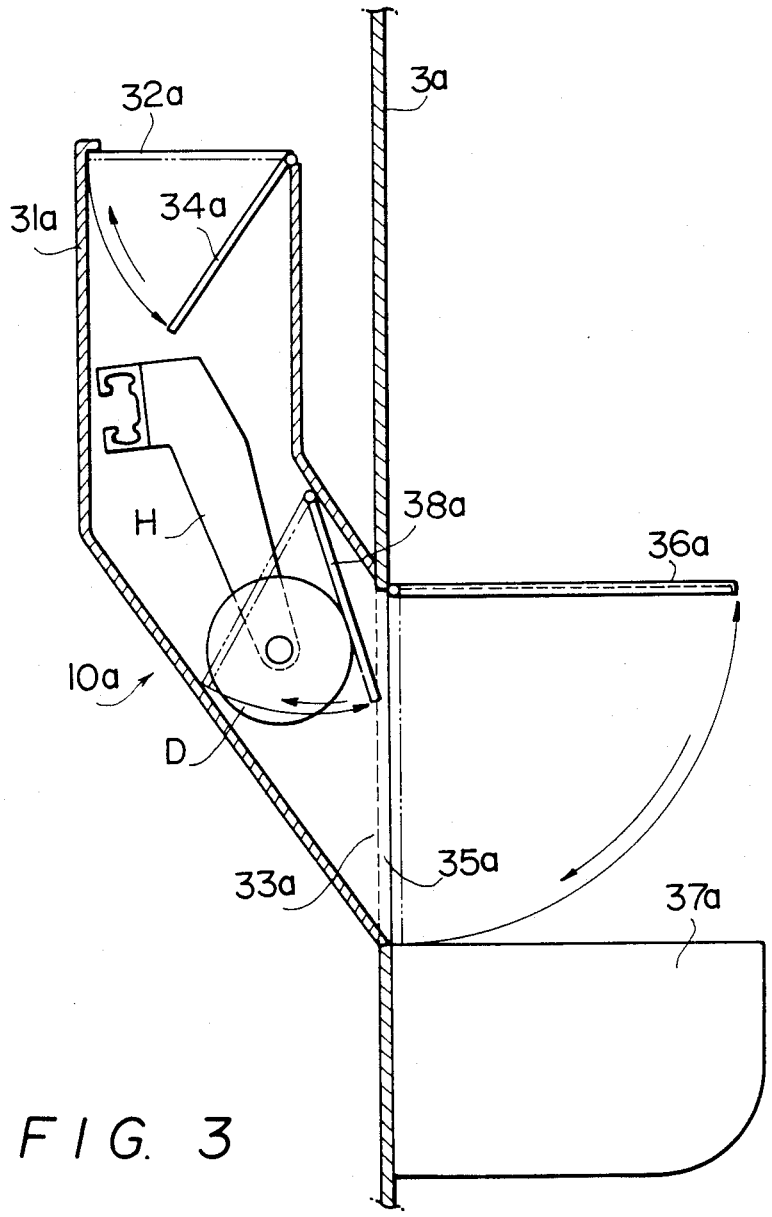
FIG. 3 is a partial vertical sectional view of the one end part of the apparatus, particularly illustrating a hanger discharge port with light shielding members fitted thereto through which the hangers with treated disc films fitted thereon are taken out from the apparatus.

As illustrated in FIG. 2 in which the disc film treating apparatus Xa is schematically shown with the upper panel 6a removed therefrom, a number of treating tanks for carrying out required treatments such as development of disc films or the like (hereinafter referred to merely as tank), a squeezing tank and a drier are arranged in a predetermined order one after another in the longitudinal direction and moreover a transporting mechanism Ta including a movable rail 61a for transporting a plurality of disc film holding hangers H (see FIGS. 3 to 7) is provided in the apparatus. Specifically, a developing tank 11a, a bleaching tank 12a, a washing tank 13a, a fixing tank 14a, a washing tank 15a and a stabilizing tank 16a each of which is utilized for development and of which length is determined in dependence on treating manner and treating time required therefor are arranged one after another along the righthand side panel 3a and in addition to them a squeezing tank 17a and a drier 18a are disposed behind the stabilizing tank 16a, whereas the movable rail 61a for the hanger transporting mechanism Ta which will be described in more details later extends in the horizontal direction above each of the aforesaid tanks. The hanger handling plate side of the movable rail 61a constitutes a hanger fitting part and the hanger discharge port side of movable rail 61a does a hanger chute part. Below the hunger chute part of the movable rail 61a is disposed the hanger discharge port 10a which comprises a hanger receiving port 32a and a shute. As is apparent from FIG. 3, the hanger receiving port 32a is adapted to be opened as an inner light shielding cover 34a is caused to turn downward by means of a falling hanger H. The chute has an opening 33a which is formed at the lower end part of the same and is communicated with a hanger removal opening 35a which is formed on the righthand side panel 3a and is adapted to be opened as an outer light shielding cover 36a is caused to turn outward by means of the falling hanger H. Reference numeral 37a designates a hanger holding pocket. Reference numeral 38a is a sensor for the passage of the hanger H.

Since the apparatus Xa is utiliized specially for treating disc films, it will be helpful that description will be made below as to a typical hanger H1 with reference to FIGS. 4 to 6 as well as a modified hanger H2 with reference to FIG. 7 before the transporting mechanism Ta is described in detail.

Figure 4:
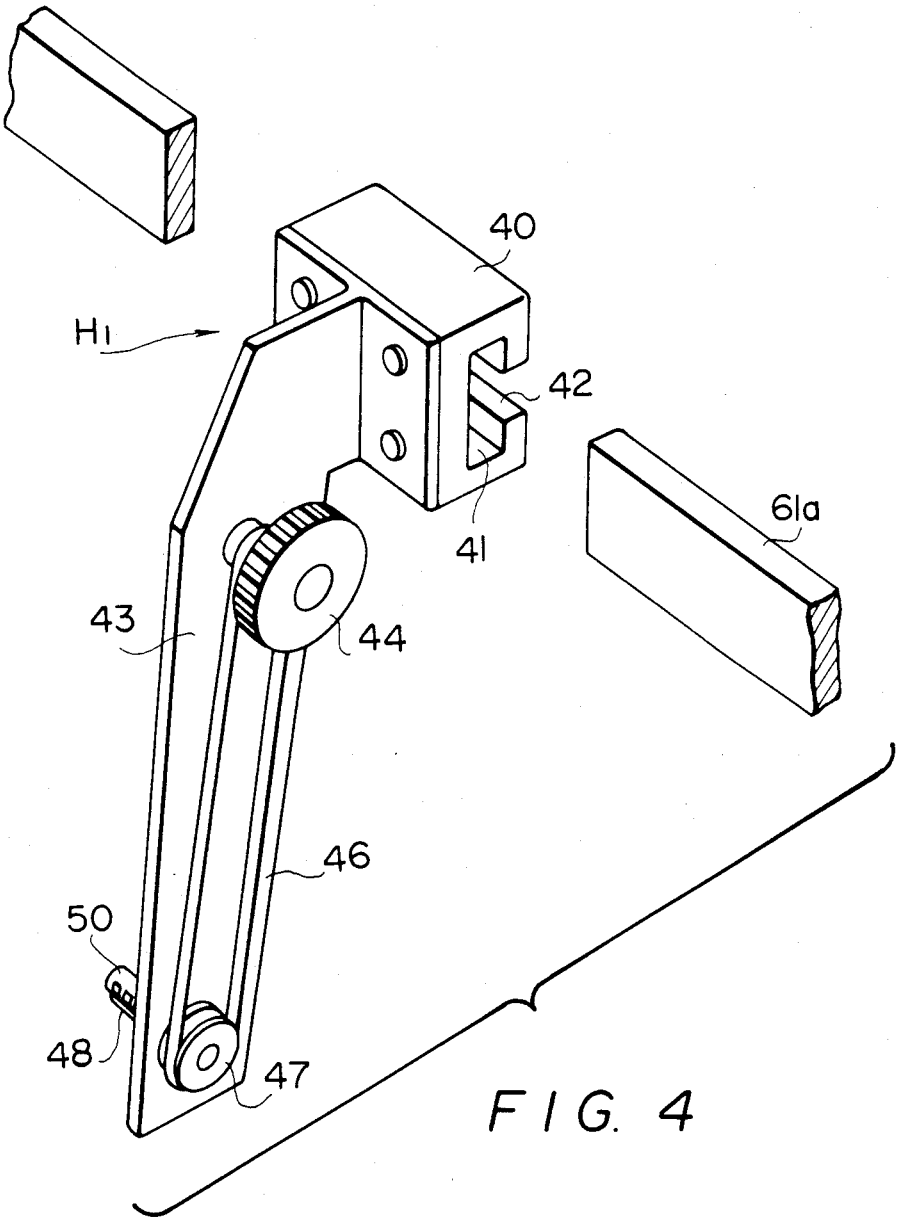
FIG. 4 is a perspective view of a hanger and associated part as constructed in accordance with an embodiment of the invention.
Figure 5:
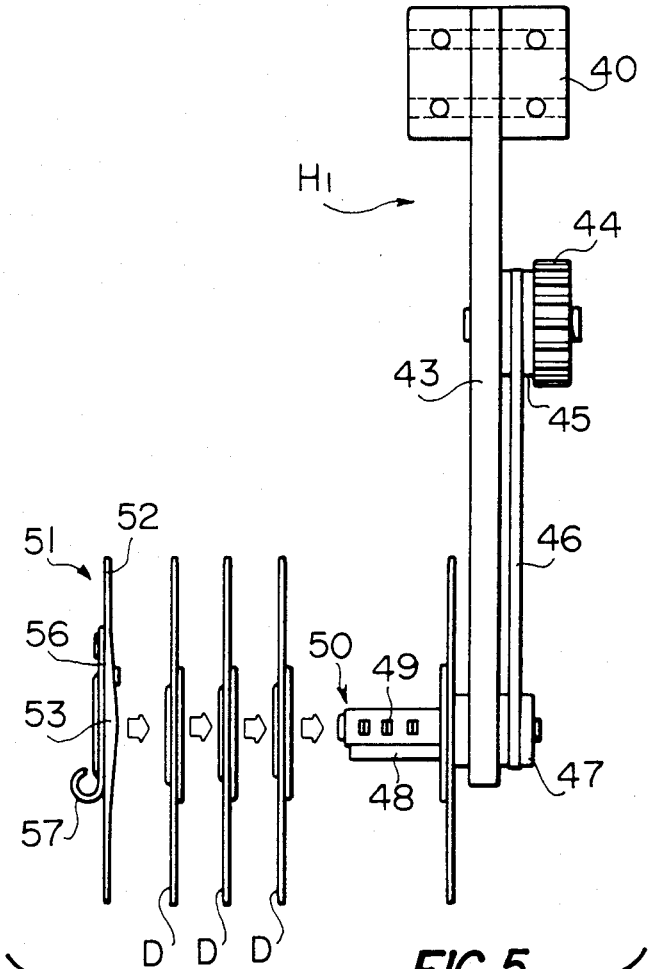
FIG. 5 is a side view of the hanger in FIG. 4, illustrating how disc films are held on the hanger.
Figure 6:
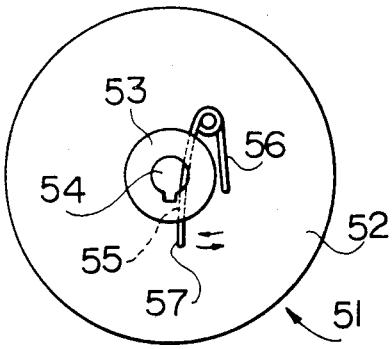
FIG. 6 is a front view of a protector for disc films to be treated which serves also as a stopper.

First, the hanger H1 as illustrated in FIGS. 4 to 6 essentially comprises a sliding body 40, a holding plate 43 extending from the central part on the left side wall of said sliding body 40 toward the interior of the respective tanks at a downward inclination angle, said left side being defined by seeing in the transporting direction a gear 44 rotatably supported on a shaft fixed to said holding plate 43 at the upper part to make meshing engagement in such a manner as to be described later, a pulley 45 made integral with said gear 44 and a pulley 47 rotatably supported at the lower part of the holding plate 43 with the aid of a bearing to be operatively connected to said pulley 45 by means of an endless rope 46 extending between both the pulleys 45 and 47, said sliding body 40 being formed with a sliding groove 41 and a slit 42, said sliding groove 41 being adapted to allow the hanger H2 to slide along the movable rail 61a of the transporting mechanism Ta and said slit 42 being adapted to allow a supporting rod 62 for the movable rail 61a (see FIG. 10) to extend therethrough. The holding plate 43 carries a disc film supporting shaft 50 extending in the opposite direction to the pulley 47, said disc film supporting shaft 50 including a projection 48 serving to guide disc films D and a protector 51 to be fitted thereon and a plurality of locking grooves 49 for locking therein said protector 51. It should be noted that the protector 51 serves also as a stopper.

The protector 51 comprises a main plate 52 which is dimensioned in diameter appreciably larger than the disc film D and has a heavy thickness portion 53 at the central part through which an insert hole 54 is extended. The main plate 52 has a spring means 56 of which one end is fixedly secured thereto and of which free end 57 is fitted through a groove 55 on the heavy thickness portion 53 until a part thereof is engaged to one of the locking grooves 49 past the insert hole 54.

Figures 7A, 7B, 7C:
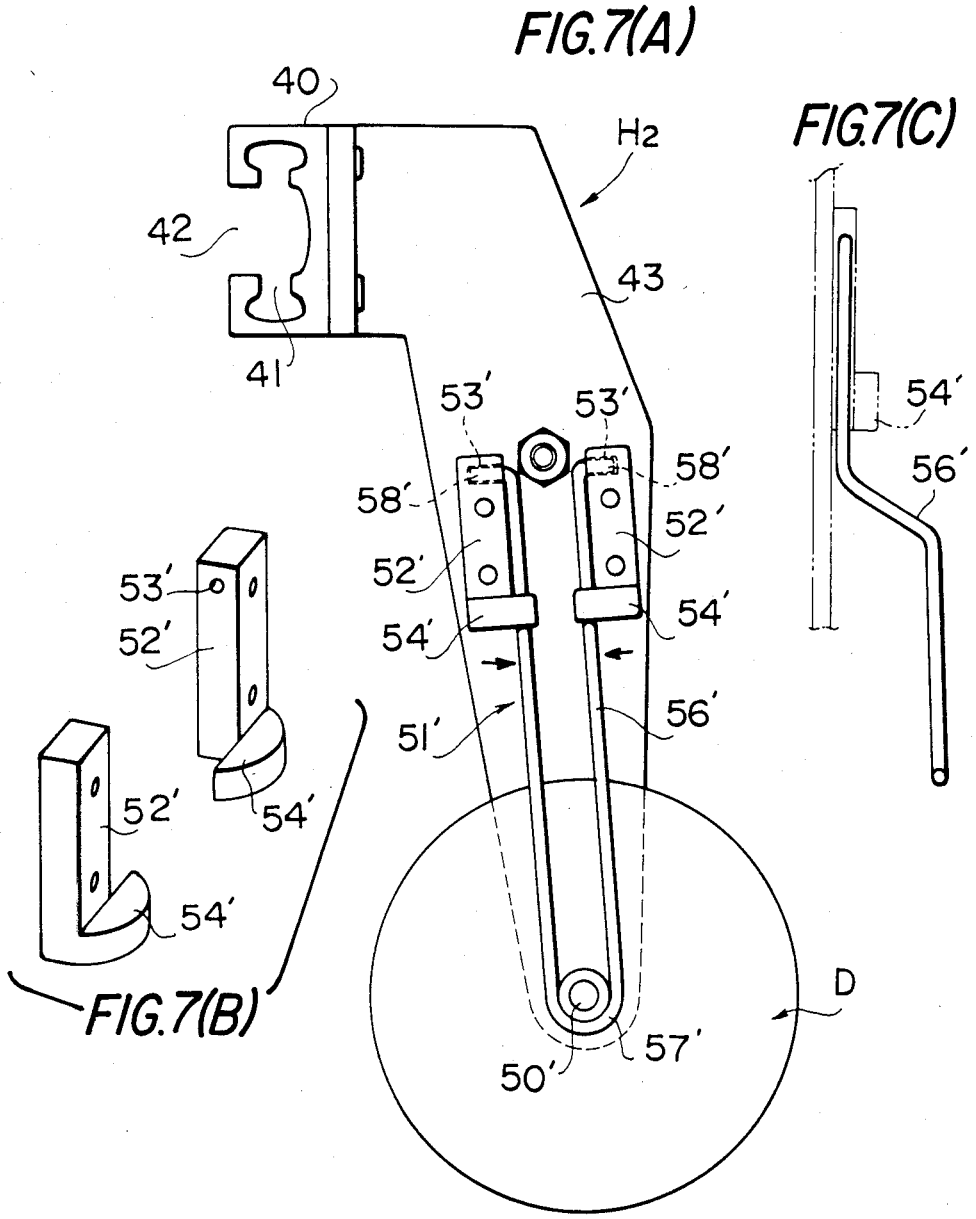
FIG. 7(A) is a front view of a hanger and associated parts as constructed in accordance with a modified embodiment of the invention, as seen in the opposite direction in FIG. 4.
FIG. 7(B) is a perspective view of a pair of holders for an U-shaped spring.
FIG. 7(C) is a partial illustration of the U-shaped spring as seen from the side in FIG. 7(A).

Next, the modified hanger H2 as illustrated in FIG. 7 is substantially same in structure as the above-mentioned hanger H1 and a difference therebetween consists in that the disc films D are firmly held on the disc film supporting shaft 50 without the aid of the protector 51 while no locking groove is formed on the disc film supporting shaft 50 as is the case with the hanger H1. The same or similar parts as those of the hanger H or similar parts which will be readily understood by any expert in the art are designated with the same numeral as is those of the hanger H1 and will not be described. Therefore, only different parts or components will be described below.

In FIG. 7 reference numeral 50' designates a disc film supporting shaft substantially equivalent to the aforesaid disc film supporting shaft 50 but has no locking groove formed thereon. The protector 51 is replaced with a disc film retainer 51' comprising a combination of an elongated U-shaped spring 56' configured so as to surround the disc film supporting shaft 50' at the lower bent part and a pair of spring holders 52' fixedly secured to the holding plate 43 at the middle part thereof in a spaced relation at a certain distance maintained therebetween whereby the disc film D is inhibited from disconnecting away from the disc film supporting shaft 50'. Specifically, both the upper parts of the U-shaped spring 56' are bent outward to be fitted pivotally into drilled holes 53', whereas the spring holders 52' are formed with a stopper projection 54' at the lower end part thereof respectively.

Now, description will be made as to the transporting mechanism T*a* which serves to transport the hangers H such as hanger H1 or H2 and then rotate the disc films D in each of the treating tanks with reference to FIGS. 8 to 12.

Figure 8:
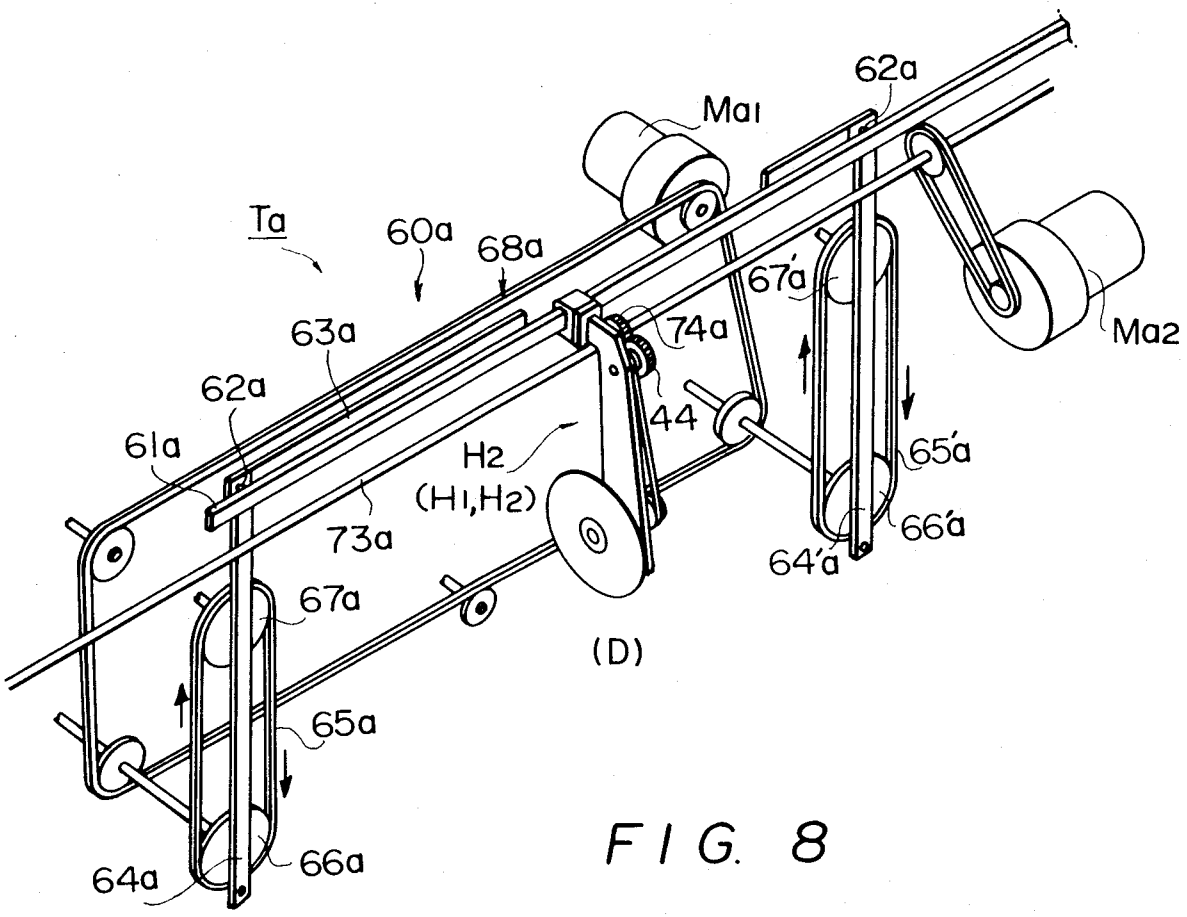
FIG. 8 is a perspective view schematically illustrating a driving system for a movable rail in a transporting mechanism.

Referring first to FIG. 8 which schematically illustrates a driving system for the movable rail 61*a* in the movable rail section 60*a* in the transporting mechanism T*a* the movable rail section 60*a* essentially comprises a movable rail 61*a*, a horizontally extending connecting rod 63*a* adapted to firmly holding said movable rail 61*a* with the aid of a plurality of supporting rods 62*a*, vertically extending connecting rods 64*a* and 64*a'*, endless chains 65*a* and 65'*a* pivotally connected to the lower end part of the vertically extending rods 64*a* and 64'*a* respectively, lower sprocket wheels 66*a* and 66'*a* and upper sprocket wheels 67*a* and 67'*a* having the same diameter to rotate at the same speed in the direction as identified with arrow marks by means of said endless chains 65*a* and 65'*a*, a combination of said lower sprocket wheels 66*a* and 66'*a* and said upper sprocket wheels 67*a* and 67'*a* being such that the movable rail 61*a* moves forward (in the rightward direction as seen in FIG. 8) while it is kept at the raised position but it moves backward (in the direction toward the front panel 22) while it is kept at the lowered position, and a rotational force transmission mechanism 68*a* adapted to transmit rotation of a motor M*a*1 to the lower sprocket wheels 66*a* and 66'*a* by way of a speed reduction mechanism. The movable rail 61*a* is dimensioned longer than the whole length of a combination of the tanks 11*a* to 16*a*, the squeeze tank section 17*a* and the drier 18 and it extends above them from the hanger fitting part where the hanger H such as hanger H1 or hanger H2 is hung up through the hanger handling plate 7*a* fitted with the light shielding bags to the hanger discharge port where the treated hanger H is disconnected from the movable rail 61*a*. The motor M*a*1 is controlled so as to stop its rotation temporarily when the joint positions where the endless chains 65*a* and 65'*a* are pivotally connected to the vertically extending rods 64*a* and 64'*a* respectively reach the lowermost end. It should be noted that parts or components for firmly supporting the structural members in the movable rail section 60*a* and those for slidably bearing them are well known by any expert in the art and therefore their illustration and description will not be required.

After the hanger H such as hanger H1 or hanger H2 with disc films D mounted thereon is inserted into the apparatus through the hanger handling plate 7*a*, it is hung up on the movable rail 61*a* by fitting the sliding groove 41 onto the latter at the foremost end part thereof when the movable rail 61*a* is stopped and it is then displaced upward or downward together with the movable rail 61*a*.

Figure 9:
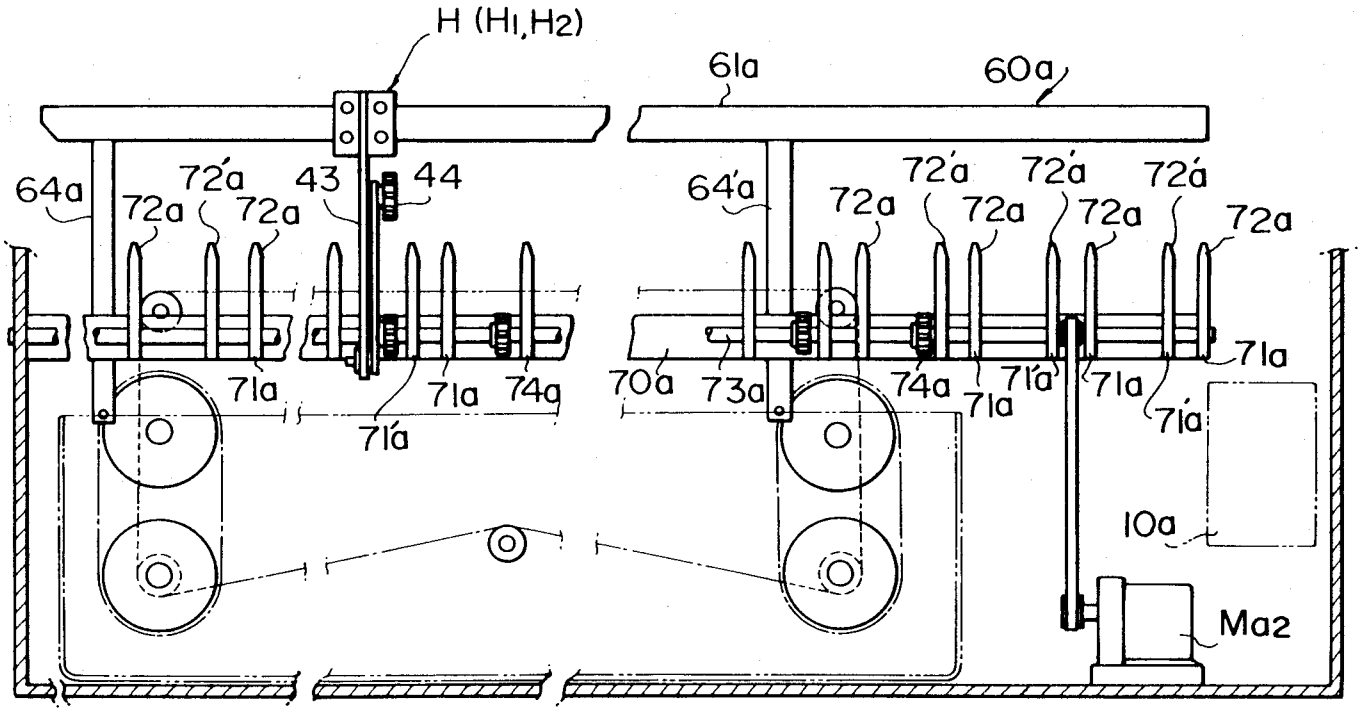
Figure 10:
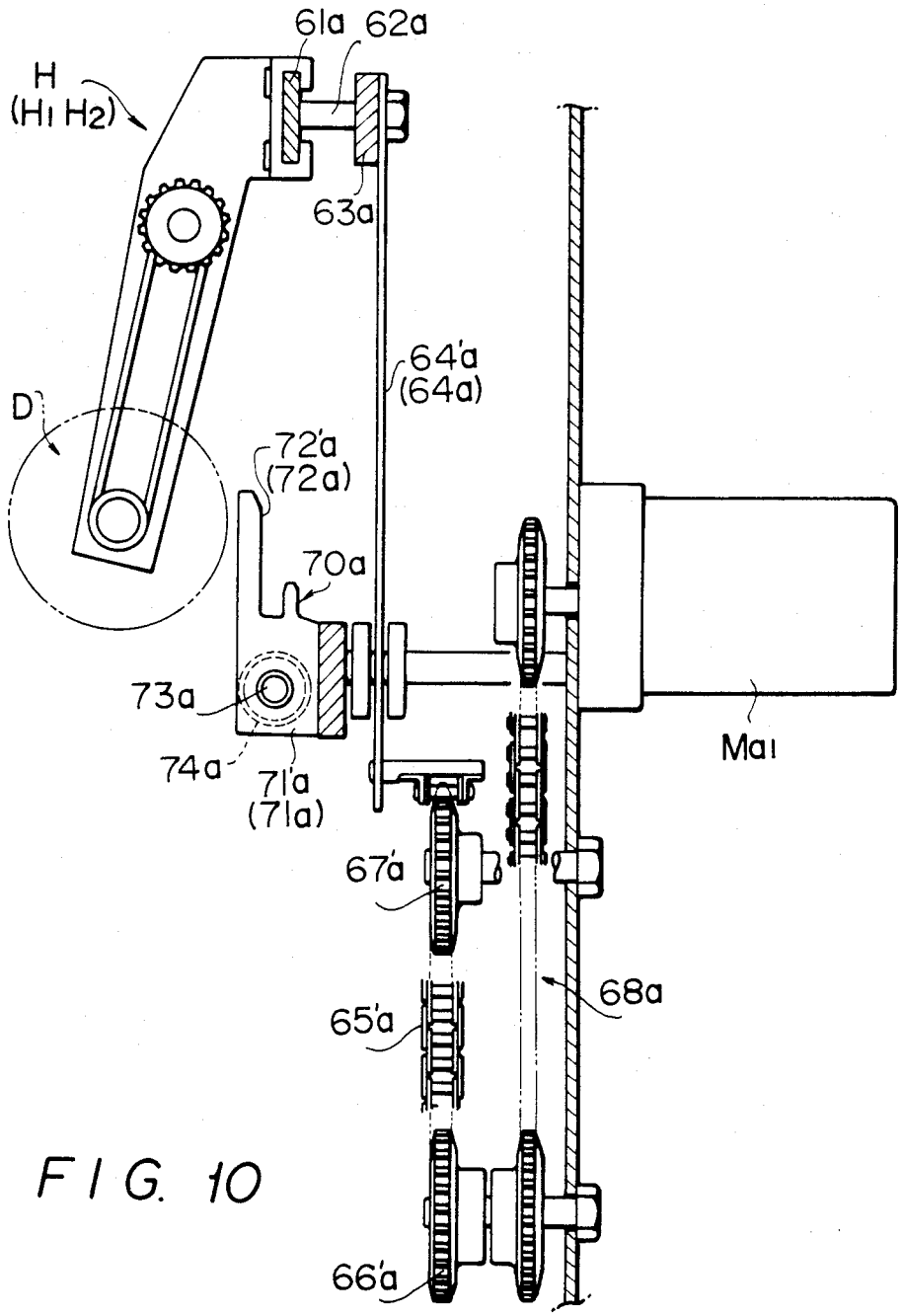
Figure 11:
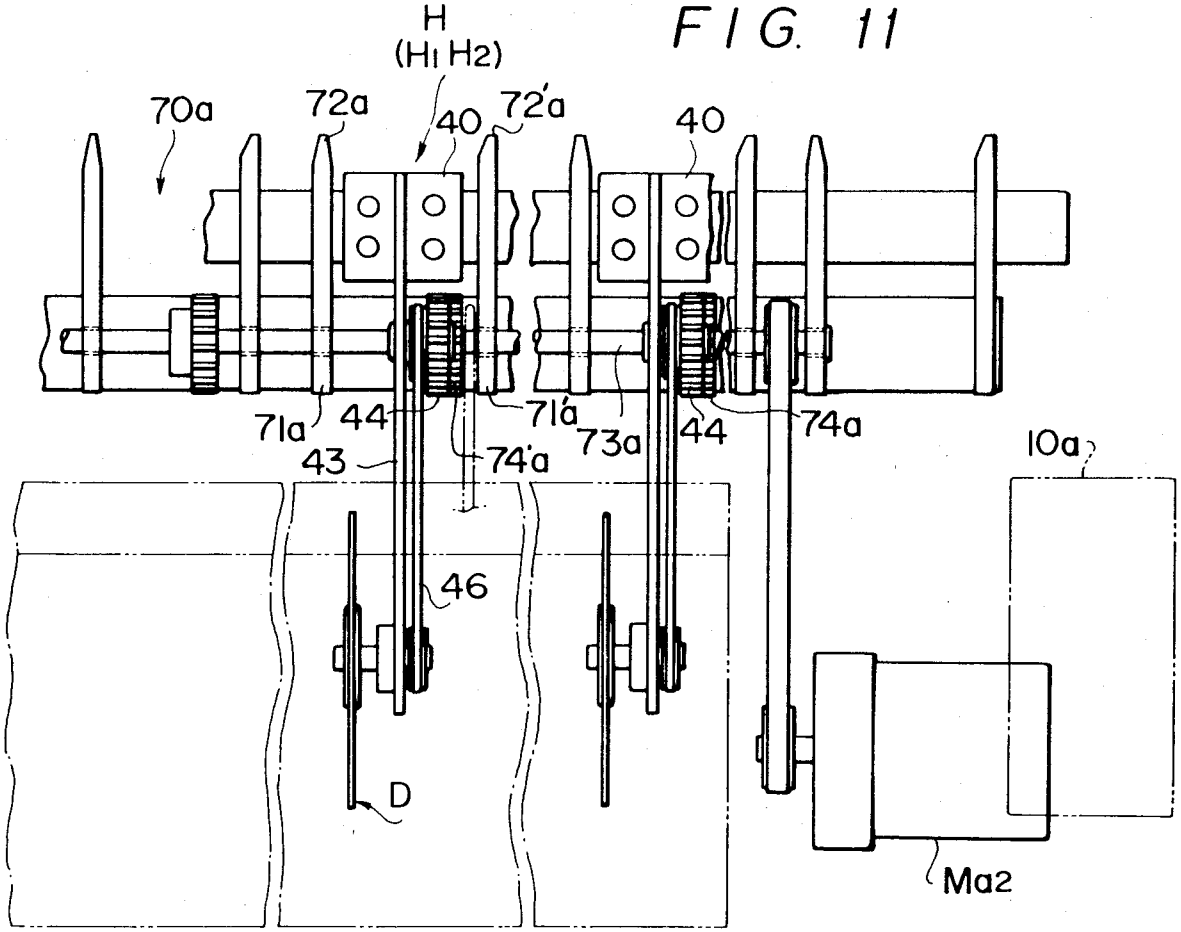

A hunger displacement prevention member 70*a* is fixed laterally above the treating tanks 11*a*, 12*a* and others and has a plural set of hanger displacement prevention plates 71*a* and 71'*a* vertically attached to a hanger displacement prevention member 70*a* at a pitch distance substantially equal to the diameter of the lower sprocket wheels 66*a* and 66'*a* in such a manner that when the hanger H starts to be lowered from the raised position as illustrated in FIGS. 9 and 10 and the joint positions where the endless chains 65*a* and 65'*a* are pivotally connected to the vertically extending rods 64*a* and 64'*a* respectively reach the lower sprocket wheels 66*a* and 66'*a* respectively, the sliding body 40 of the hanger H is caused to come in contact with hanger lowering guide rods 72*a* and 72'*a* of hanger displacement prevention plates 71*a* and 71'*a* as illustrated in FIG. 11. In addition to the hanger lowering guide rods 72*a* and 72'*a* the hanger displacement prevention plates 71*a* and 71'*a* on the hanger displacement prevention member 70*a* rotatably carries a rotary shaft 73*a* to which rotation of the motor M*a*2 is transmitted, said rotary shaft 73*a* having a plurality of gears 74*a* fitted thereon. When the hanger H is lowered and the motor M*a*1 comes to a stop, the gear 44*a* on the hanger H is brought in meshing with one of the gears 74*a* on the rotary shaft 73*a* and thereby the disc film supporting shaft 50 or 50' is rotated by means of the motor M*a*2 while the motor M*a*1 is stopped. It should be noted that only the gear 74'*a* on the squeeze tank section 17*a* is held free on the rotary shaft 73*a* while it is fitted with collars for the purpose of preventing an occurance of displacement in such a manner as to be described later.

Thus, after the hanger H with a plurality of disc films D mounted thereon is slidably fitted onto the movable rail 61*a* in the movable rail section 60*a*, it starts to move from the position where the endless chains 65*a* and 65'*a* are temporarily stopped and reaches the stop position again whereby a cycle of operation is completed with displacement by a distance equivalent to one pitch accomplished. At every time of stoppage the disc films D are immersed into each of the tanks 11*a*, 12*a* and others successively while they are rotated at about 200 r.p.m. so that an intended treatment is completed.

Figure 12:
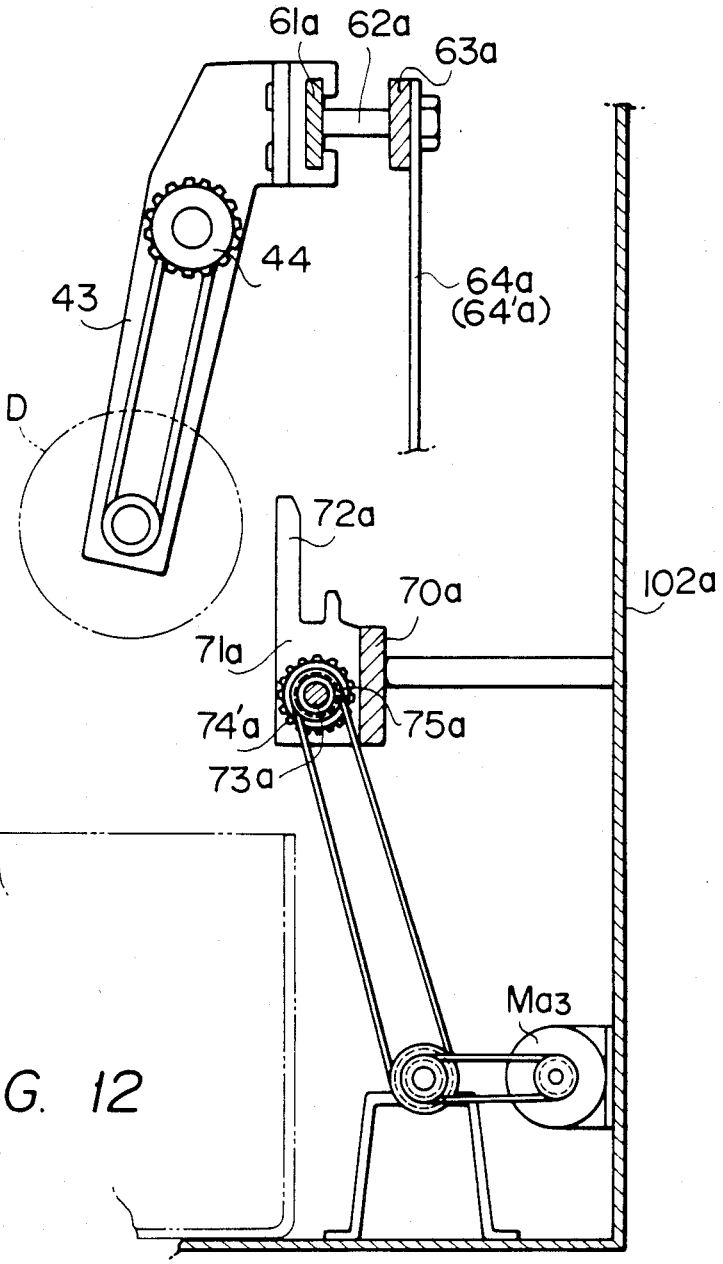

It should be noted that with respect to the gear 74'*a* disposed above the squeeze tank section 17*a* rotation of an independent motor M*a*3 is transmitted to the gear 74'*a* by way of a speed reduction mechanism and a pulley 75*a* made integral with the gear 74'*a* so that the latter is rotated at a speed of about 2,000 r.p.m. for the purpose of assuring water draining in the squeeze tank, as illustrated in FIG. 12.

Figure 13:
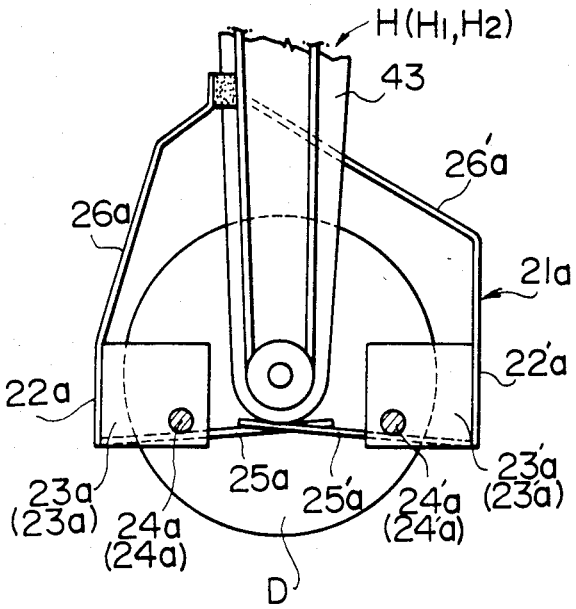
Figure 14:
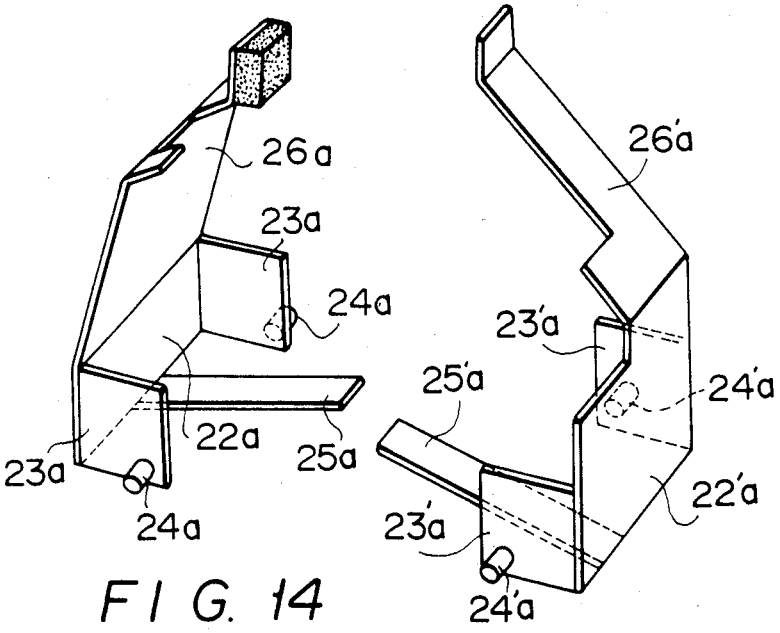

To inhibit water droplets from being scattered away during the water draining a water droplet scattering prevention member 21*a* is provided in the squeeze tank 17*a* in such a manner that it is caused to turn by means of downward force from the lower end of the holding plate 43 of the hanger H so as to cover the disc films D which rotate at a high speed on the disc film supporting shaft 50 or 50', as illustrated in FIG. 13. As is best seen in FIG. 14, the water droplet scattering prevention member 21*a* comprises side plates 23*a* and 23'*a*, main plates 22*a*, 22'*a*, pivotal shafts 24*a*, 24'*a* extending from said side plates 23*a*, 23'*a*, main plate turning plates 25*a*, 25'*a* extending from the lower end part of the main plates 22*a*, 22'*a* at a slight upward inclination angle and disc film cover plates 26*a* and 26'*a* extending from the upper end part of the main plates 22*a*, 22'*a* at an upward inclination angle. As illustrated in FIG. 15, the water droplet scattering prevention member 21*a* is designed so that the disc film cover plates 26*a* and 26'*a* are normally displaced away from one another while they turn about the pivotal shafts 24*a* and 24'*a* in the squeeze tank 17*a* and as the hanger H is lowered the lower end of the holding plate 43 abuts against the innermost end part of the main plate turning plates 25*a* and 25'*a* at the same time.

Incidentally, the drier 18 includes a plurality of pipes with a number of hot air blowing nozzles fitted thereon which are conventionally used for this kind of equipments and therefore their illustration and description will not be required.

Now, operations of the disc film treating apparatus as constructed in accordance with the first embodiment of the invention in the above-described manner will be described below.

Disc films D to be treated are inserted into the apparatus through the hanger handling plate 7a to be mounted on the disc film supporting shaft 50 or 50' of hanger H such as hanger H1 or hanger H2. Then, the hanger H with the disc films D mounted thereon is slidably fitted onto the movable rail 61a so that it practices a series of movements comprising raising, forward movement, lowering and backward movement within one section as defined by the hanger displacement prevention member 70a, accompanied by temporary stoppage at the lowermost position of the movable rail 61a. While the hanger H is temporarily stopped at the last mentioned position, the disc film supporting shaft 50 or 50' is caused to rotate in each of the development tank 11a, the bleaching tank 12a, the washing tank 13a, the fixing tank 14a, the washing tank 15a and the stabilizing tank 16a so that the disc films D are subjected to predetermined treatments. Next, the disc films D are rotated at a higher speed for water draining as a preliminary step in the squeeze tank section 17a to facilitate drying and they are then completely dried in the drier 18a. After completion of the whole treatments the hanger H with the treated disc films D mounted thereon are caused to fall down at the extreme end part of the movable rail 61a, and it is then taken out through the hanger discharge port 10a. As will be readily understood from the above description, it becomes possible to carry out a series of treatments starting with development and ending by drying for a plurality of disc films D in a single treating apparatus designed and constructed in a small size as is different from any of the hitherto known disc film treating apparatuses. Thus, an improved apparatus for treating photosensitive material having a specific configuration has been provided in accordance with the present invention.

Next, description will be made as to an apparatus for treating photosensitive material in accordance with the second embodiment of the invention, that is, a disc film treating apparatus for specially treating disc films D in accordance with the second embodiment of the invention with the aid of hangers H (generally designating hanges H1 and hangers H2) which have been described above with respect to the first embodiment of the invention.

The general structure of the treating apparatus X*b* for specially treating disc films in accordance with the second embodiment of the invention will be described mainly with reference to FIG. 16 which is a perspective view of the treating apparatus and additionally with reference to FIG. 17 which is a sectional plan view of the same. In the drawings reference numeral 1b designates an outer panel constituting a frame structure and a dark box for the treating apparatus X*b*, reference numeral 2b does a front panel, reference numeral 3b does a righthand side panel, reference numeral 4b does a lefthand side panel, reference numeral 5b does a rear panel and reference numeral 6b does an upper panel. Further, a control panel 8b including switch buttons, push buttons and displays for starting or stopping operation of each of parts or components required for treating the disc films D simultaneously or individually or controlling speed of their operation and displaying their operational condition is provided in the substantially same manner as the conventional treating apparatus for treating a long length photographic film such as 35 mm film or the like. A removable hanger handling plate 7b with light shielding bags fitted therewith for inserting disc films D and hangers H (generally designating hangers H1 and hangers H2) therethrough is arranged on the upper panel 6b at the position located in the proximity of the front panel 2b, whereas a hanger discharge port 9b with an openable door attached thereto is disposed at the position behind the hanger handling plate 7b. A part of the upper panel 6b and the lefthand and righthand side panels 3b and 4b is designed to be openable or removable for the purpose of inspecting or repairing the interior of the dark box in the same manner as in the foregoing first embodiment.

Figure 17:
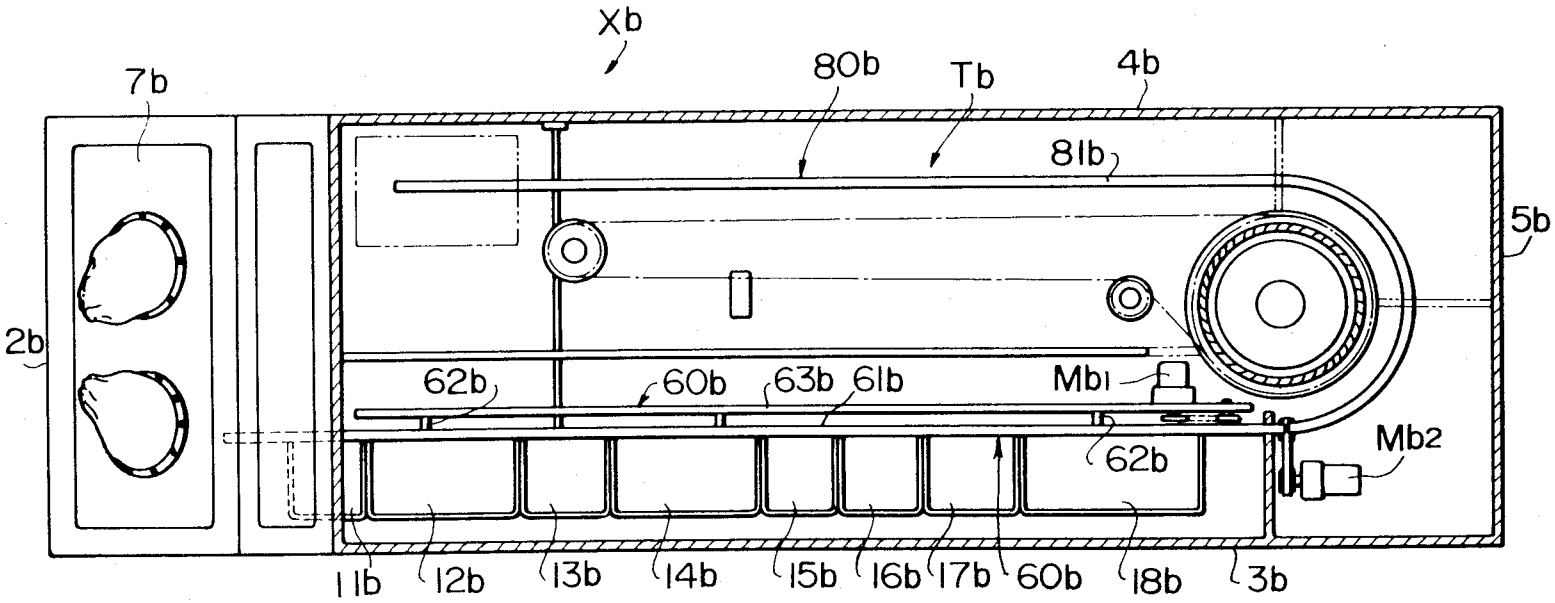
FIG. 17 is a plan view of the apparatus similar to FIG. 2 with an upper panel removed therefrom, schematically illustrating how a plurality of treating tanks, a squeeze tank section, a drier section and a transporting system for hangers with disc films fitted thereon are arranged in the dark box.

FIG. 17 is a sectional plan view of the treating apparatus similar to FIG. 2 and a series of tanks comprising a developing tank 11b, a bleaching tank 12b, a washing tanks 13b, a stabilizing tank 14b, a washing tank 15b, a stabilizing tank 16b, a squeeze tank section 17b and a drier 18b are arranged in line along the righthand side panel 7b in the same manner as in the first embodiment, said squeeze tank section 17b being equipped with a water droplet scattering prevention member (not shown) which is constructed in the same manner as the water droplet scattering prevention member 21 disposed in the squeeze tank section 17a in accordance with the first embodiment. Further, a transporting mechanism T*b* essentially comprising a movable rail section 60b and a stationary rail section 80b for transporting hangers H is arranged above the aforesaid tank in such a manner as to be described later.

Now, the transporting mechanism T*b* including the movable rail section 60b and the stationary rail section 80b as essential components for transporting the hangers H such as hangers H1 and hangers H2 will be described in more details below.

First, description will be made as to the movable rail section 60b. As will be apparent from FIG. 18 which illustrates a driving system for driving both the movable rail section 60b and the stationary rail section 80b and FIGS. 19 to 22 which illustrate a plurality of mechanisms for rotating the disc films D to carry out intended treatments therefor during the transportation of the hangers H, a movable rail 61b, supporting rods 62b, a horizontally extending connection rod 63b, vertically extending connection rods 64b, 64'b, endless chains 65b, 65'b, sprocket wheels 66b, 66'b, 67b, 67'b, a rotational power transmission mechanism 68b, a hanger displacement prevention member 70b, hanger displacement prevention plates 71b, 71'b, hanger lowering guide rods 72b, 72'b, a rotary shaft 73b, gears 74b, 74'b, a pulley 75b and motors Mb1, Mb2, Mb3 in the movable rail section 60b in the second embodiment are same or substantially same in structure and function as the movable rail 61a the supporting rods 62a, the horizontally extending connection rod 63a, the vertically extending connection rods 64a, 64'a, the endless chains 65a, 65'a, the sprockets wheels 66a, 66'a, 67a, 67'a, the rotational power transmission mechanism 68a, the hanger displacement prevention member 70a, the hanger displacement prevention plates 71a, 71'a, the hanger lowering guide rods 71a, 72'a, the rotary shaft 73a, the gears 74a, 74'a, the pulley 75a and the motors Ma1, Ma2, Ma3 in the movable rail section 60a in the foregoing first embodiment. Accordingly, their repeated description will not be required and description will be made only with respect to a structural part as identified with reference numeral 69b, that is, a concave cutout 69b which is required for the second embodiment but not for the foregoing first embodiment of the invention. Specifically, the concave cutout 69b is used for the purpose of assuring smooth transference of the hangers H generally designating the hangers H1 and the hanger H2 from the movable rail 61b to the stationary rail section 80b which will be described later and it is designed such that it has a considerable thickness in the vertical direction and no bumping is made between the rear end part of the movable rail 61b adapted to practice circulative movement and the fore end part of the stationary rail 81b.

Figure 18:
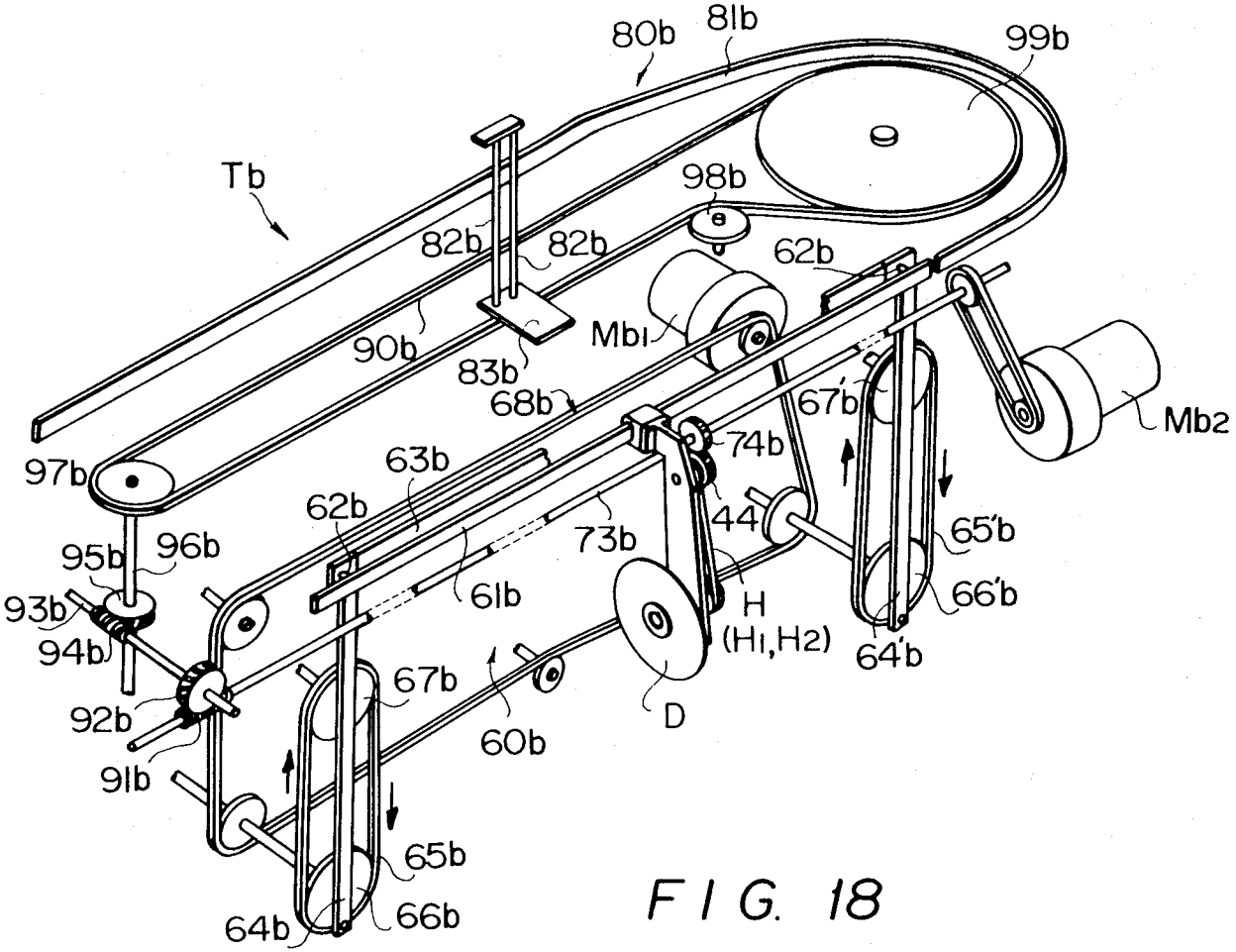
FIG. 18 is a schematic perspective view of the transporting system in FIG. 17, particularly illustrating how driving is effected for a movable rail section and a stationary rail section.
Figure 19:
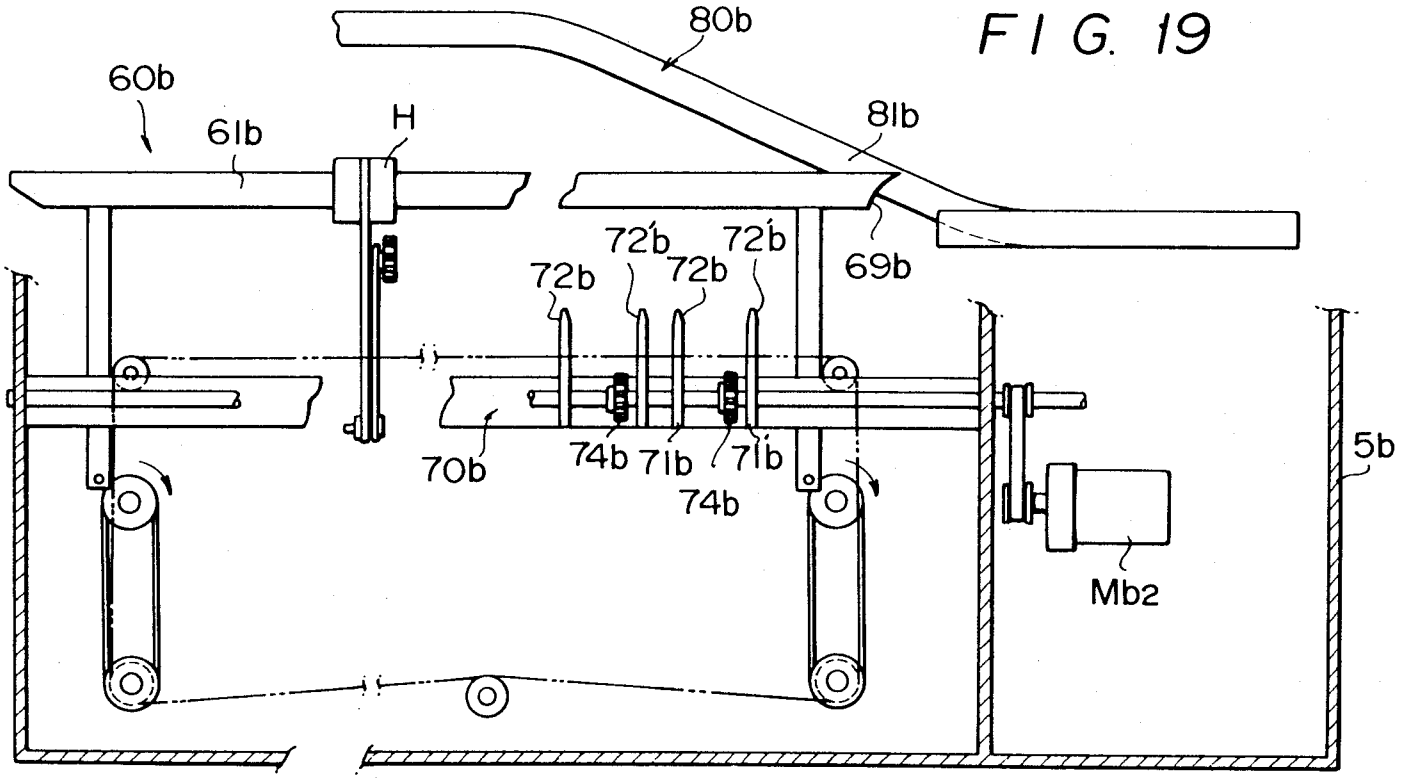
FIG. 19 is a side view of the movable rail section with a part thereof cut off, particularly illustrating how a hanger is transported.
Figure 20:
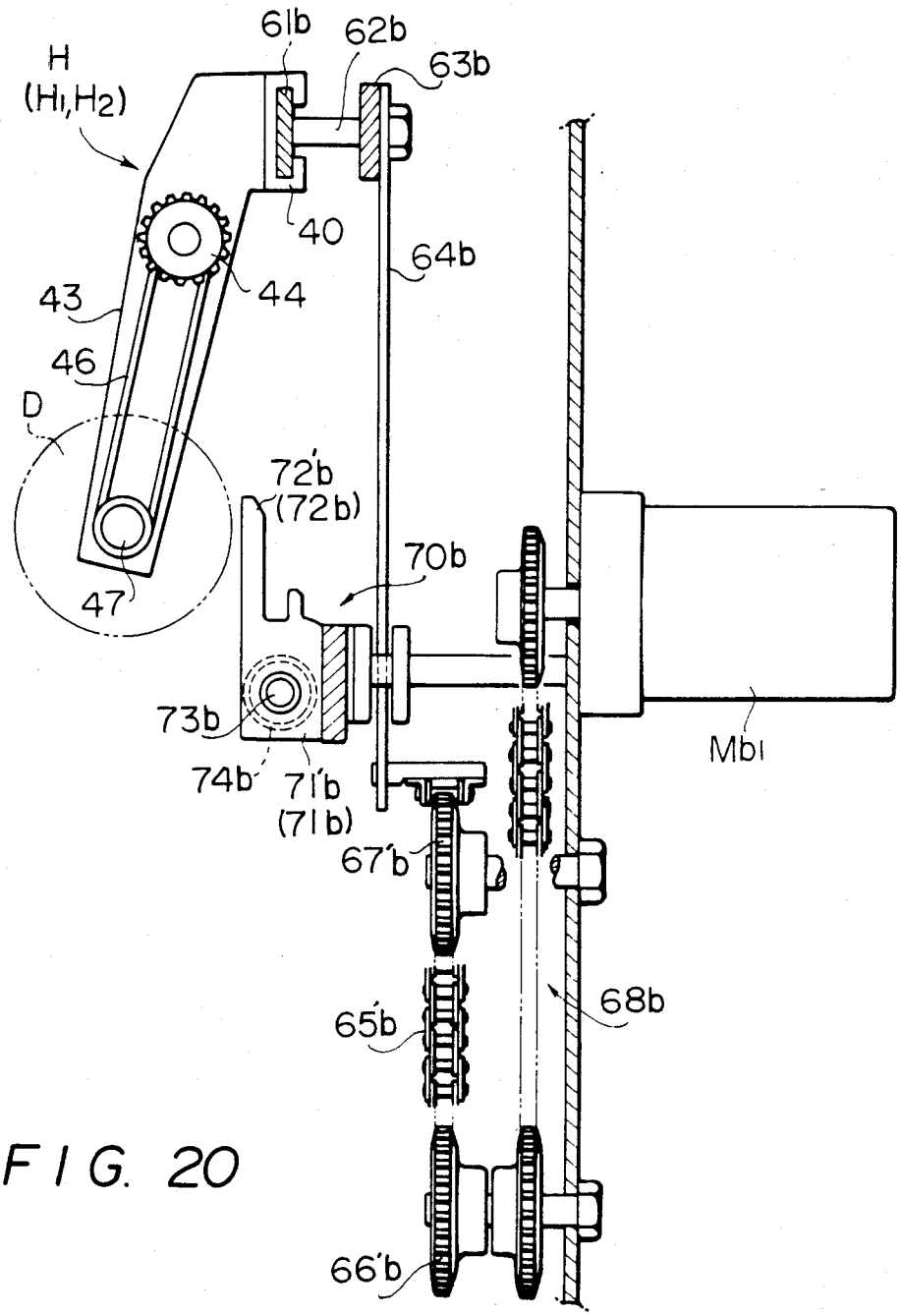
FIG. 20 is an enlarged vertical sectional view of the movable rail section, particularly illustrating the movable rail when it is raised up.
Figure 21:
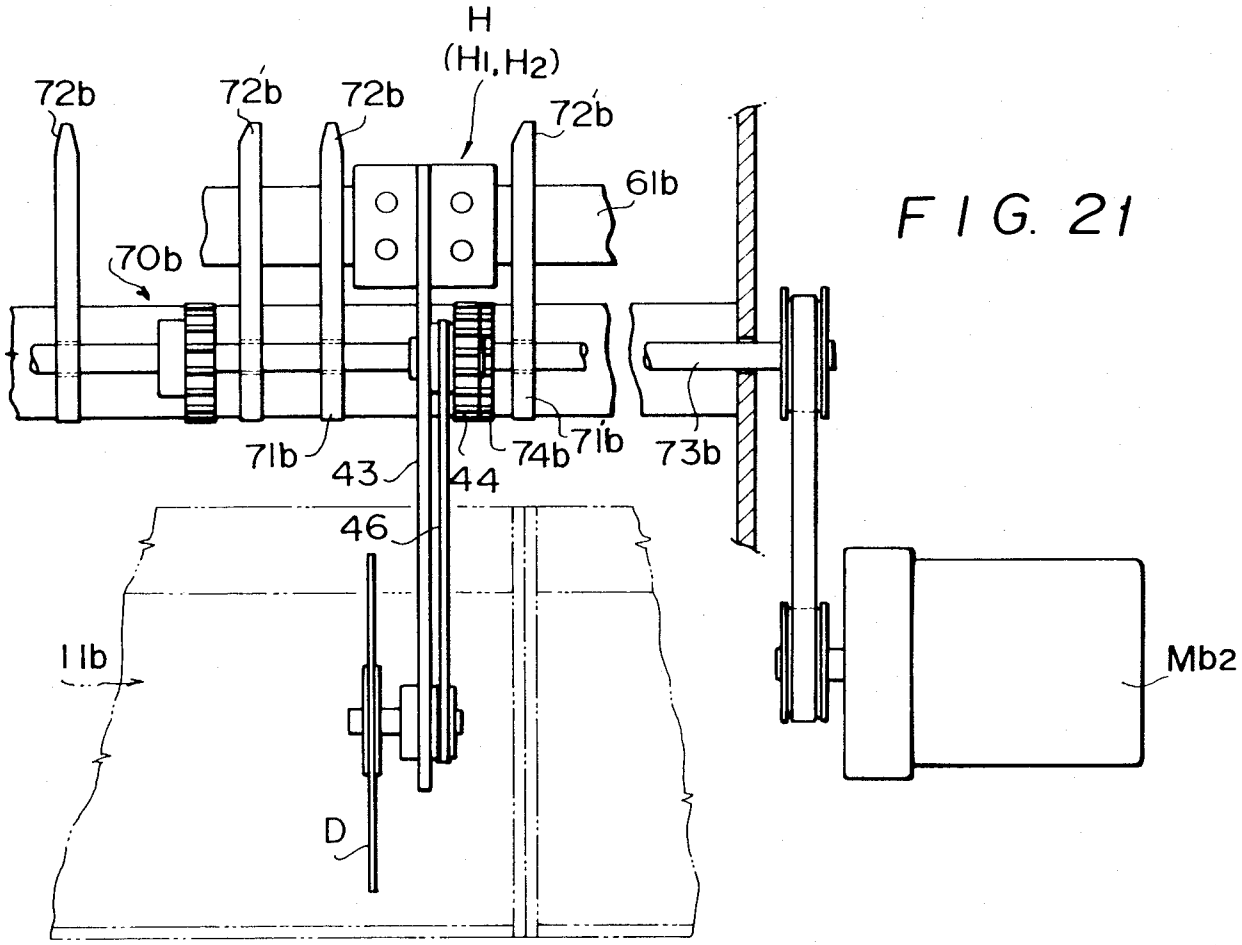
FIG. 21 is an enlarged partial view, particularly illustrating how rotational force is transmitted to the disc film supporting shaft on the hanger when the movable rail is lowered.
Figure 22:
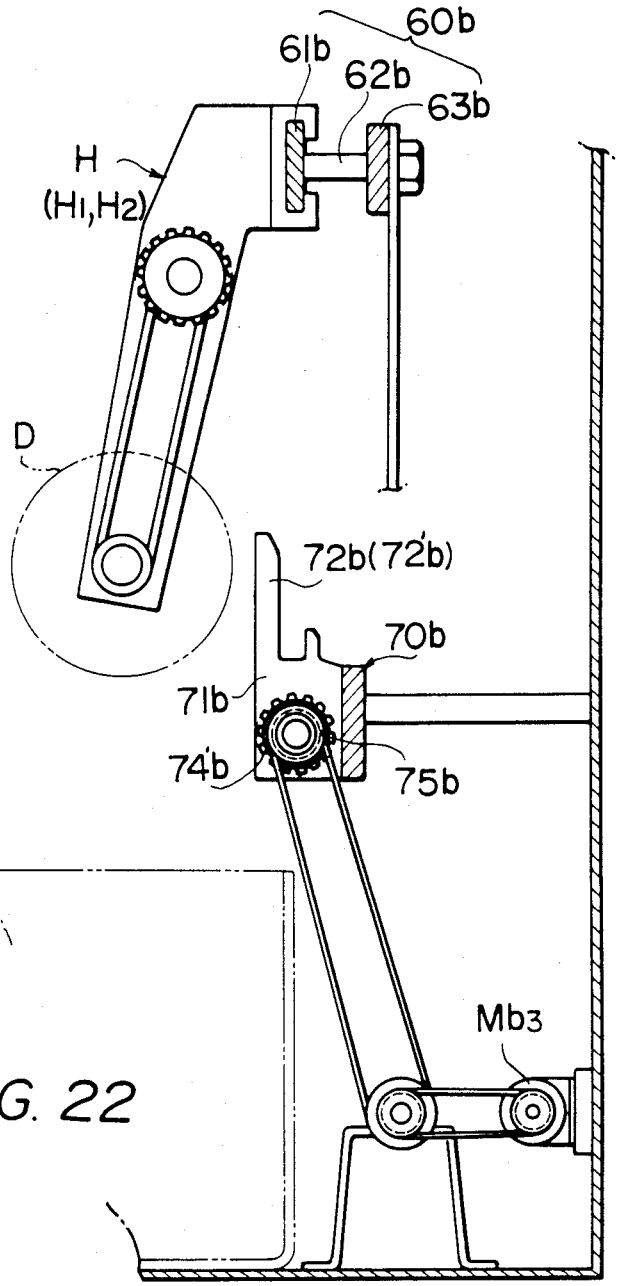
FIG. 22 is an enlarged vertical sectional view similar to FIG. 20, particularly illustrating how rotational force is transmitted to the disc film supporting shaft on the hanger in the squeeze tank section.
Figure 23:
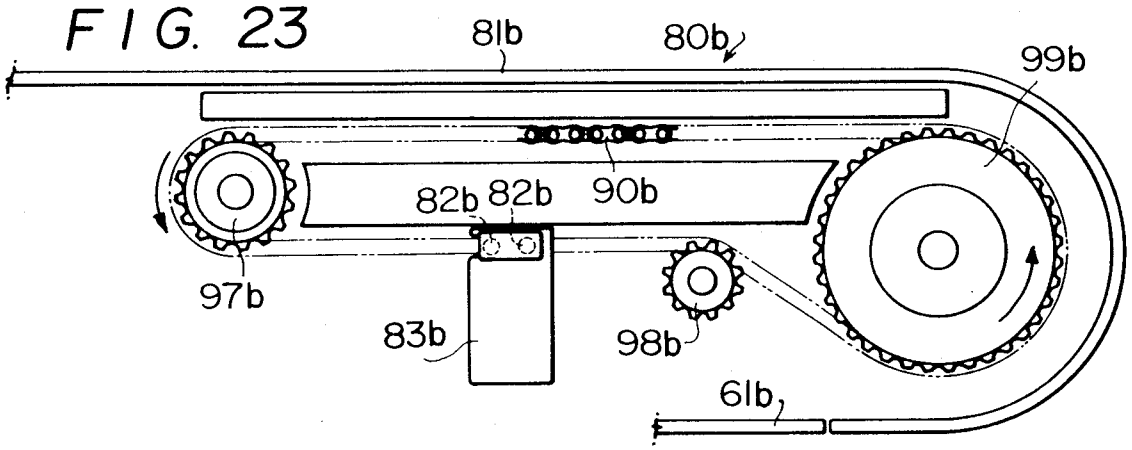
FIG. 23 is a partial plan view of the transporting system, particularly illustrating how a hanger thrusting plate is circulatively operated within the stationary rail.
Figure 24:
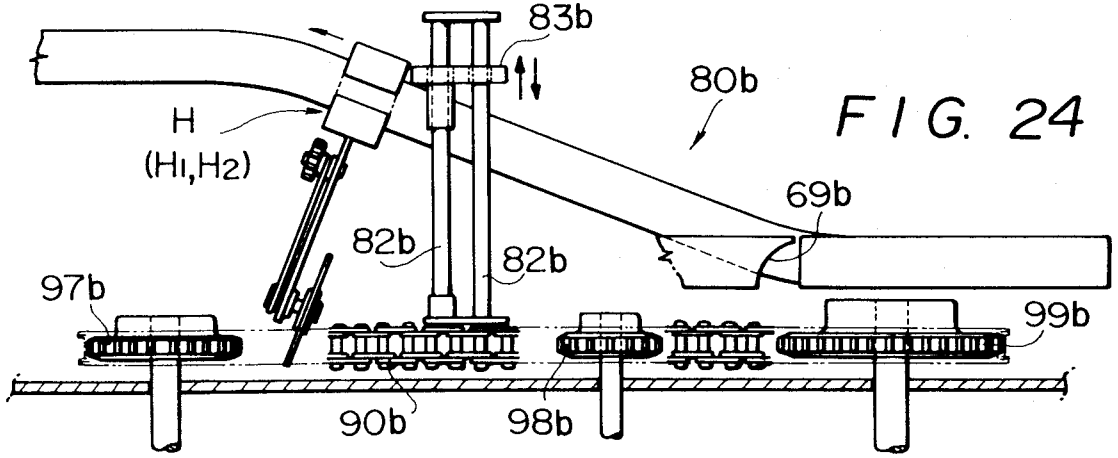
FIG. 24 is an enlarged partial side view of the transporting system, particularly illustrating how the hanger is transfered along the stationary rail with the aid of the hanger thrusting plate.

Next, the stationary rail section 80b will be described with reference to FIGS. 23 and 24 in addition to FIGS. 18 and 19. The stationary rail 81b in the stationary rail section 80b has the same cross-sectional configuration as that of the movable rail 61b and both the rails 61b and 81b are brought in linear alignment with one another when the movable rail 61b is lowered and comes to a temporary stop. The stationary rail 81b may be extended in the horizontal direction until it reaches a hanger discharge port with a light shielding member fitted therewith (not shown) on the rear panel 5b in the same manner as in the first embodiment, but in the illustrated second embodiment the stationary rail section 80b essentially comprises a stationary rail 81b extending to the position located below the hanger discharge port 9b with an openable door fitted therewith on the upper panel 6b by way of a semicircular bent portion with a certain slope added thereto in view of the distance by which the movable rail 61b is displaced in the vertical direction, a worm 91b on the rotary shaft 73b (see FIG. 18), a worm wheel 92b on a rotary shaft 93b in meshing engagement with said worm 92b, another worm 94b on the rotary shaft 93b, another worm wheel 95b on a rotary shaft 96b in meshing engagement with said worm 94b, a sprocket wheel 97b on the rotary shaft 96b, an intermediate sprocket wheel 98b, a large sprocket wheel 99b disposed within the semicircular bent portion of the stationary rail 81b, an endless chain 90b circulatively extended around the three sprockets 97b, 98b and 99b under tension imparted thereto and a hanger thrusting plate 83b adapted to transfer the hanger H such as hanger H1 or hanger H2 from the movable rail 61b to the stationary rail 81b when the hanger H is delivered to the rear end part of the movable rail 61b with the aid of the hanger displacement prevention member 70b while it is displaced in the vertical direction along the pair of guide rods 82b vertically extending in parallel to one another, said movable rail 61b and said stationary rail 81b being brought in linear alignment with one another as the former is lowered and comes to a temporary stop. Alternatively, the guide rods 82b may be replaced with a single guide rod, when a modification is achieved so that the latter has a square configuration as seen in a cross-section.

Next, description will be made as to operation of the treating apparatus for specially treating disc films in accordance with the second embodiment of the invention which is constructed as described above. First, disc films D to be treated are fitted one by one onto the disc film supporting shaft 50b or 50'b on the hanger H such as hanger H1 or hanger H2 by manual operation with operator's hands which are inserted through the hanger handling plate 7b. Then, the hanger H with disc films D fitted thereon is hung up on the movable rail 61b by fitting the sliding groove 41 on the sliding body 40 of the hanger H onto the latter. The hanger H is caused to move forward by one section as defined by the hanger displacement prevention member 70b by way of a series of movements of the movable rail 61b comprising raising, forward movement, lowering and backward movement. When it is lowered to the lowermost position, it comes to a temporary stop so that intended treatments are performed for the disc films D in each of the developing tank, the bleaching tank, the washing tank, the fixing tank, the washing tank and the stabilizing tank. After completion of the intended treatments the treated disc films D are rotated at a high speed in the squeeze tank section 17b while they are covered with the water droplet scattering prevention member which is not shown in the drawings whereby water is removed from the disc films. They are then dried in the drier 18b and thereby all the treatments are completed. The hanger H1 or the hanger H2 with the treated disc films fitted thereon is displaced to the rear end part of the movable rail 61b and while it is located at the lowermost position where the latter is held immobile, it is transfered to the stationary rail 81b from the movable rail 61b by means of the hanger thrusting plate 83b arranged in the stationary rail section 80b. After the hanger H such as hanger H1 or hanger H2 is transfered to the stationary rail section 80b, it is then displaced further to the position located below the hanger discharge port 9b with an openable door fitted thereto with the aid of the hanger thrusting plate 83b. Finally, it is manually taken out from the treating apparatus.

As will be readily understood from the above description, the treating apparatus for specially treating disc films in accordance with the second embodiment consists in that the plural number of disc films are subjected to a series of treatments starting with developing and ending with drying in a single apparatus designed in smaller dimensions so as to meet the current requirements for the disc film treating apparatus in the same manner as the treating apparatus for specially treating disc films in accordance with the first embodiment.

Finally, description will be made as to a specially designed apparatus for treating photosensitive material in accordance with the third embodiment of the invention with reference to FIGS. 25 and 26.

In practice, the third embodiment of the invention has been proposed with the current problems in mind that a quantity of demand for disc films is very limitative at present, compared with the conventional long length photographic films which are widely known as 35 mm film and the conventional long length photosensitive printing paper and therefore it is economically disadvantageous to keep a space only for mounting a treating apparatus for specially treating disc films in accordance with the first or second embodiment of the invention. Further, another problem is that it will take long time and labor work to handle treating liquids in the respective tanks after completion of operation due to the fact that the apparatus is usually kept inoperative for a long period of time. Thus, the third embodiment of the invention consists in that the same or substantially same treating apparatus for specially treating disc films as proposed in accordance with the first embodiment of the invention is combined with a conventional treating apparatus for treating long length photographic film and photosensitive printing paper. It should be noted that the conventional treating apparatus for treating long length photographic film or the like is identified with two dott-chain lines in FIGS. 25 and 26 for the purpose of simplification of illustration.

Figure 25:
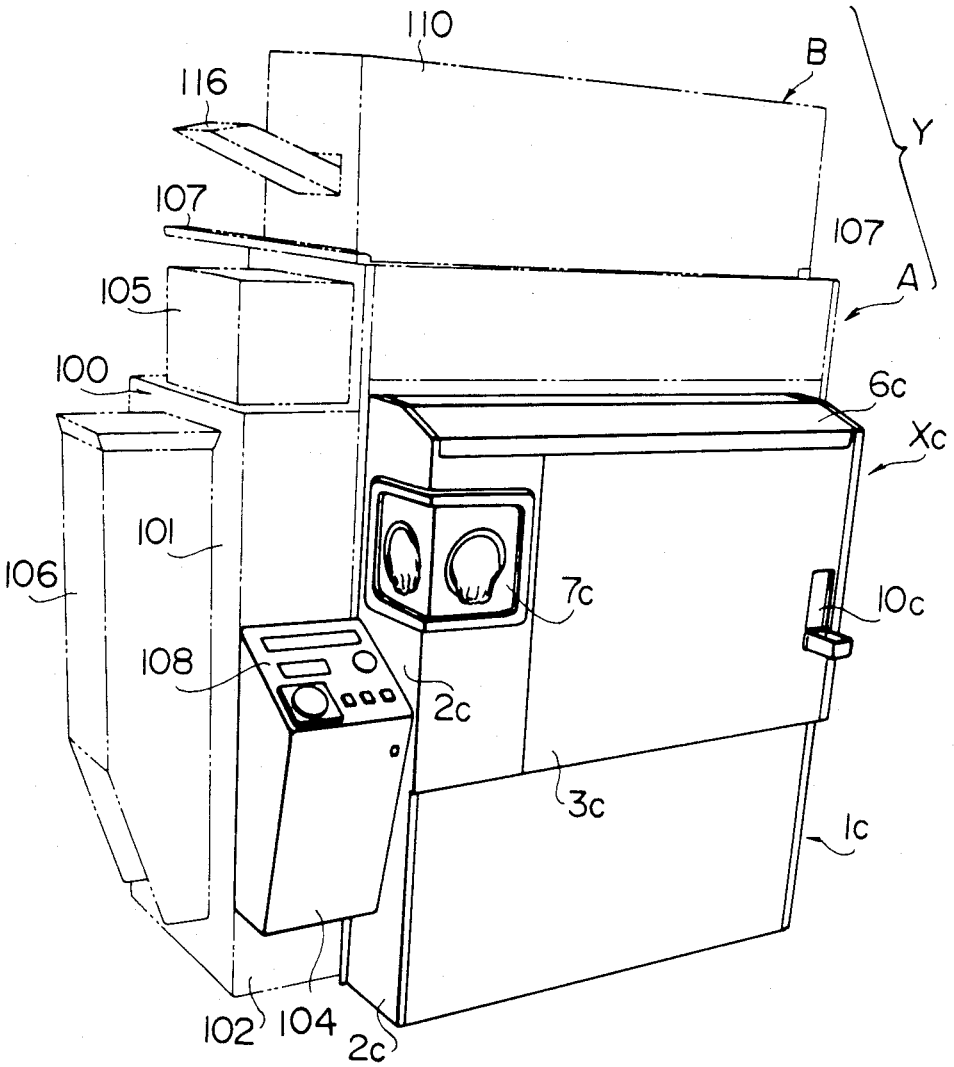
FIG. 25 is a perspective view of a treating apparatus for treating photosensitive material in accordance with the third embodiment of the invention, which is combined with a conventional treating apparatus section for treating long length photographic films such as 35 mm films or the like as shown by two dott-chain lines.

In FIG. 25 which is a perspective view of the treating apparatus for treating photosensitive material in accordance with the third embodiment in which the portion of the conventional treating apparatus for treating long length photographic films, that is, the conventional treating apparatus for treating photosensitive material is identified with two dott-chain lines, reference letter Y designates a treating apparatus including an automatic developing apparatus section A for treating long length photographic films and an automatic drier section B for drying treated photographic films and reference letter X*c* does a treating apparatus for specially treating disc films. Since the first mentioned treating apparatus Y is a hitherto known treating apparatus and the last mentioned treating apparatus is same or substantially same to the treating apparatus proposed in accordance with the first embodiment, the treating apparatus in accordance with the third embodiment will be described only with respect to structural components which become specific to the invention by combining the treating apparatus Y with the treating apparatus X*c*. However, description and illustration of some of the components which are well known to any expert in the art will be not required but their designation will be effected by means of reference numerals.

Now, description will be made as to the automatic developing apparatus section A in the treating apparatus Y. In the drawing reference numeral 100 designates an outer panel constituting the frame structure as well as the dark box for the apparatus section, reference numeral 101 does a front panel and reference numeral 102 does a righthand side panel, wherein a part of the outer panel 100 is designed to be openable or removable for the sake of easy inspection and repairing. Further, a plurality of treating tanks for carrying out developing treatment and others for long length photographic films or the like are arranged in line in the dark box of which part is constituted by the outer panel 100. Reference numeral 105 designates an insert box through which long length photographic films or the like are inserted into the apparatus and reference numeral 106 does a stocker for holding treated photographic films therein.

On the other hand, with respect to the automatic drier section B reference numeral 110 designates an outer panel constituting the frame structure for the apparatus section in the same manner as in the foregoing, reference numeral 116 does a discharge guide for photographic films after completion of their drying and reference numeral 107 does rails fixedly secured onto the rear part of the upper panel of the automatic developing apparatus section A (located at the righthand side as seen in FIG. 25) and the fore part of the same (located at the lefthand side as seen in FIG. 25), said rails 107 serving for mounting the automatic drier section B thereon as well as for displacing the same in the direction toward the lefthand side panel. After a photographic film is inserted into the apparatus through the insert box 105, it is subjected to development in the automatic developing apparatus section A and drying in the automatic dryier section B and it is then discharged from the latter via the discharge guide 116 into the stocker 106 where it is stored.

Next, with respect to the treating apparatus X*c* for specially treating disc films reference numerals 1*c*, 2*c*, 3*c*, 5*c* (see FIG. 26) and reference numerals 6*c*, 7*c*, 10*c* are identical in structure to the outer panel 1*a*, the front panel 2*a*, the righthand side panel 3*a*, the rear panel 5*a*, the upper panel 6*a*, the hanger handling plate 7*a* with light shielding bags fitted therewith and the hanger discharge port 10*a* with a light shielding member fitted thereto in the first embodiment. It should be noted that the lefthand side panel consituting the outer panel 1*c* of the treating apparatus X*c* serves also as a righthand side panel 102 constituting the outer panel 100 of the automatic developing apparatus section A in the treating apparatus Y (see FIG. 26).

Further, in the drawings reference numeral 104 designates a control box disposed on the wall surfaces of the righthand side panel 102 and the front panel 2*c*, of which upper panel 108 serves as a control panel including thereon a plurality of switch buttons, push bottons and displays for starting or stopping operation of the respective actuating parts or components for the treating apparatuses X*c* and Y simultaneously or individually, controlling a speed of operation and displaying the current operating conditions.

Figure 26:
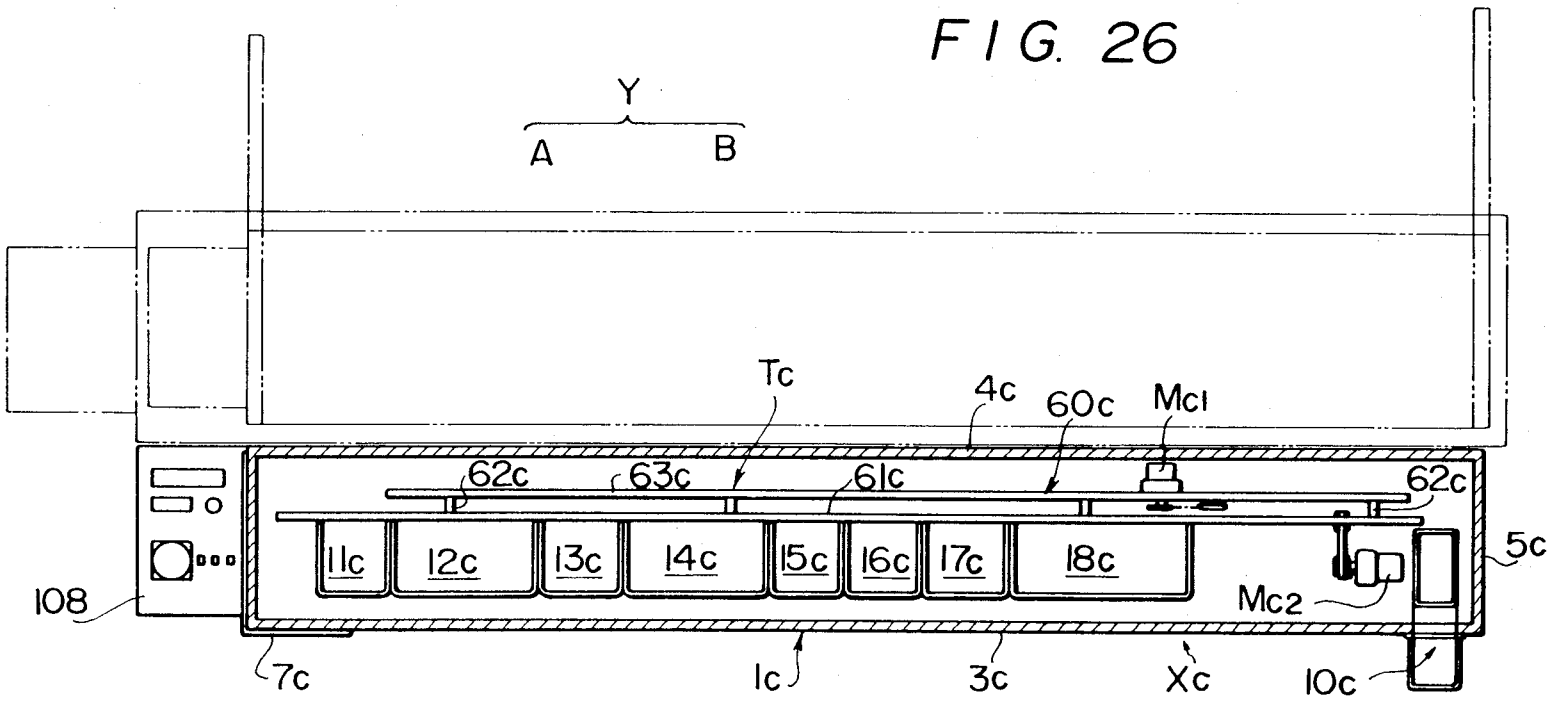
FIG. 26 is a plan view of the treating apparatus in FIG. 25 with an upper panel on the apparatus section for specially treating disc films removed therefrom in the same manner as in FIGS. 2 and 17, particularly illustrating how a plurality of treating tanks, a squeeze tank section, a drier section and a transporting system for hangers with disc films fitted thereon are arranged in the dark box of the aforesaid apparatus section, wherein the conventional apparatus section for treating long length photosensitive material is shown by two dott-chain lines.

A series of tanks identical in structure and function to the developing tank 11*c*, the bleaching tank 12*c*, the washing tank 13*c*, the fixing tank 14*c*, the washing tank 15*c*, the stabilizing tank 16*c*, the squeeze tank 17*c* and the drier 18*c* in the first embodiment are arranged in the dark box constituted by the panels of the treating apparatus X*c*, a part of said tanks being schematically illustrated in FIG. 26. Further, a transporting mechanism T*c* is arranged in the dark box for the purpose of transporting hangers H in the treating apparatus X*c*.

In this connection it should be noted that the corresponding treating tanks in both the treating apparatuses X*c* and Y are operatively in use with one another in such a manner that the same kind of treating liquid flows therebetween, it is pumped out from the bottom thereof, it is pumped up to the upper part of the other tanks, waste liquid in the squeeze tanks is drained from the bottom thereof simultaneously or individually by actuating valves and hot air is supplied into or exhausted from the drier sections simultaneously or individually by actuating valves and that the above-described operations can be practiced or carried out with the aid of conventional technical means and therefore illustration and description of the latter will not be required.

As will be apparent from the above description, the treating apparatus in accordance with the third embodiment of the invention makes it possible to treat conventional long length photographic films in the treating apparatus for treating long length photographic films in the same manner as the conventional one and at the same time treat the recently developed disc films in the treating apparatus for specially treating disc films in the above-mentioned manner. Accordingly, advantageous features of the treating apparatus in accordance with the third embodiment consist in the specific functional effects inherent to the respective apparatus sections are attained simultaneously or individually and a part of the outer panel constituting the frame structure of the first mentioned apparatus section serves as a part of the outer panel constituting the frame structure and the dark box of the last mentioned apparatus section while they are arranged in parallel to one another in a joined relation. As a result increased efficiency of operation of the whole apparatus is assured in spite of few opportunity of operating the apparatus section for specially treating disc films, accompanied by necessity for relatively reduced area for mounting the whole apparatus, whereby improved economical effect is attained for this kind of treating apparatus for treating photosensitive material.

While the present invention has been described above only with respect to three preferred embodiments, it should be of course understood that it should not be limited only to them and many changes and modifications may be made without any departure from the spirit and scope of the invention.

What is claimed is:

1. Apparatus for treating photosensitive material in the form of a disc film comprising:

a dark box having a series of treating sections for conducting treatments of a disc film comprising at least a developing step, a bleaching step, a fixing step and a stabilizing step with washing steps interposed as appropriate between the respective steps;

a hanger having a supporting shaft to support at least one disc film;

a rotational force transmission means adapted to rotate said supporting shaft; and a hanger transporting mechanism which is adapted to carry at least one hanger from an entrance to an exit of said dark box so as to allow treatments in respective steps of said disc film supported by said hanger;

said hanger transporting mechanism comprising:

a movable rail being disposed through said dark box from the entrance to the exit and adapted to hang said hanger in a cantilever fashion and to allow said hanger to slide in the longitudinal direction of said movable rail;

a driving member for bringing said movable rail into cyclical movement with each cycle comprising an upward movement, forward movement in the direction of said movable rail, downward movement and backward movement in order, and further providing a dwell period for said hanger at the lowermost position; and means for preventing the backward movement of said hanger by engaging said hanger at the lowermost position to keep it stationary during the backward movement of said movable rail but permitting said upward, forward and downward movements together with said movable rail.

2. Apparatus as defined in claim 1, wherein said hanger comprises a bearing portion to embracingly engage said movable rail and a downwardly extending arm portion upon which is mounted said supporting shaft.

3. Apparatus as defined in claim 2, wherein said rotational force transmission means comprises a driving pulley and a driven gear member being rotatably supported by a shaft which is perpendicularly projected from said arm portion, a driven pulley being mounted on an extended portion of said supporting shaft and an endless belt being wound between said driving and driven pulley, further said driven gear member being adapted to be rotated by a driving gear member which is mounted to a driving axis provided along said movable rail.

4. Apparatus as defined in claim 1, wherein said supporting shaft of said hanger has a ridge portion and a plurality of recesses for fixedly supporting a plurality of disc films.

5. Apparatus as defined in claim 4, wherein a stopper means is provided for preventing said disc films from slipping off of said supporting shaft.

6. Apparatus as defined in claim 5, wherein said stopper means comprises a stopper disc plate fitted to said supporting shaft having a thickened center portion formed with a slit for inserting a stopper spring therethrough to engage one of said recesses.

7. Apparatus as defined in claim 6, wherein said stopper disc has at least the same diameter as the diameter of said disc film so as to protect said disc film from damage during the treatment.

8. Apparatus for treating photosensitive material in the form of a disc film as defined in claim 5, wherein said stopper means is formed by a U-shaped spring pin to clip the projected end of said supporting shaft.

9. Apparatus as defined in claim 1, wherein said driving member comprises a vertically spaced pair of driving and driven sprockets, a chain being wound between said sprockets, and a transmission means consisting of a pin being projected from said chain, a vertically extended connecting rod being pivotally connected with said connecting pin at one end, the other end of said connecting rod being connected to said movable rail.

10. Apparatus as defined in claim 1, wherein said apparatus further comprising a stationary rail disposed at a post-treating position in series with said movable rail and a hanger pushing means for transferring said hanger to said stationary rail.

11. Apparatus as defined in claim 1, wherein said dark box has a squeeze tank and a water droplet scattering prevention member so as to cover said disc film which is caused to rotate on said supporting shaft at a high speed when said hanger is lowered to the lowermost position.

* * * * *